US006450089B2

(12) United States Patent
Ackley

(10) Patent No.: US 6,450,089 B2
(45) Date of Patent: Sep. 17, 2002

(54) METHOD AND APPARATUS FOR SPIN PRINTING INDICIA ON PELLET SHAPED ARTICLES

(75) Inventor: E. Michael Ackley, Stone Harbor, NJ (US)

(73) Assignee: Ackley Machine Corporation, Moorestown, NJ (US)

( * ) Notice: Subject to any disclaimer, the term of this patent is extended or adjusted under 35 U.S.C. 154(b) by 0 days.

(21) Appl. No.: 09/877,001

(22) Filed: Jun. 11, 2001

Related U.S. Application Data

(63) Continuation-in-part of application No. 09/059,205, filed on Apr. 14, 1998.

(51) Int. Cl.[7] ..... B41F 17/08

(52) U.S. Cl. ..... 101/38.1; 101/35; 101/484; 101/486

(58) Field of Search ..... 101/35, 36, 37, 101/38.1, 39, 40, 484, 485, 486

(56) References Cited

U.S. PATENT DOCUMENTS

| | | | |
|---|---|---|---|
| 3,552,311 | A | 1/1971 | Petri |
| 3,868,900 | A | 3/1975 | Ackley |
| 3,869,981 | A | 3/1975 | Davis |
| 3,871,295 | A | 3/1975 | Ackley |

FOREIGN PATENT DOCUMENTS

| | | |
|---|---|---|
| EP | 0 324 046 | 1/1988 |
| EP | A-477395 | 1/1992 |

(List continued on next page.)

*Primary Examiner*—Ren Yan
(74) *Attorney, Agent, or Firm*—Oliff & Berridge PLC

(57) ABSTRACT

A method and apparatus orient, position and spin print indicia on pellet shaped articles, such as pharmaceutical capsules and the like. More specifically, the method and apparatus use a rotating pick-up drum that receives and transports the pellet shaped articles to a rotating positioning drum that is synchronized with the pick-up drum. The positioning drum receives the pellet shaped articles from the pick-up drum and properly aligns the pellet shaped articles so that they may be transferred to a rotating printing drum which is also synchronized with the positioning drum. The printing drum contains a vacuum source that maintains the pellet shaped articles within pockets as the pellet shaped articles are passed through a printing station. The printing station contains a movable printing roller capable of being moved toward and away from the printing drum such that the printing roller accurately spin prints indicia onto the pellet shaped articles. A control unit is connected to the apparatus and is configured to control, among other features of the apparatus, the rotation speed of the drums, but also the speed, position and/or contact force of the printing roller in relationship to the rotating printing drum. This control may be performed based on information associated with a length of the band of indicia of one of the pellet shaped articles, which is detected by a detection device. The detection device may be an optical device such as a video camera or a photo sensor.

24 Claims, 18 Drawing Sheets

U.S. PATENT DOCUMENTS

| | | | |
|---|---|---|---|
| 3,889,591 | A | 6/1975 | Noguchi |
| 3,889,595 | A | 6/1975 | Jaffa |
| 3,931,884 | A | 1/1976 | Ackley |
| 4,069,753 | A | 1/1978 | Ackley et al. |
| 4,104,966 | A | 8/1978 | Ackley, Jr. et al. |
| 4,167,226 | A | 9/1979 | Ackley et al. |
| 4,208,962 | A | 6/1980 | Ackley, Sr. et al. |
| 4,231,462 | A | 11/1980 | Ackley, Sr. et al. |
| 4,254,704 | A | 3/1981 | Ackley, Sr. et al. |
| 4,266,477 | A | 5/1981 | Ackley |
| 4,266,478 | A | 5/1981 | Ackley |
| 4,327,825 | A | 5/1982 | Ackley, Sr. et al. |
| 4,335,810 | A | 6/1982 | Ackley et al. |
| 4,353,456 | A | 10/1982 | Yamamoto |
| 4,369,702 | A | 1/1983 | Ackley |
| 4,372,437 | A | 2/1983 | Ackley, Sr. et al. |
| 4,377,971 | A | 3/1983 | Ackley |
| 4,393,973 | A | 7/1983 | Ackley, Sr. et al. |
| 4,394,933 | A | 7/1983 | Ackley |
| 4,413,556 | A | 11/1983 | Ackley |
| 4,437,559 | A | 3/1984 | Ackley, Sr. et al. |
| 4,479,573 | A | 10/1984 | Ackley, Sr. et al. |
| 4,500,012 | A | 2/1985 | Ackley |
| 4,632,028 | A | 12/1986 | Ackley |
| 5,376,771 | A | 12/1994 | Roy |
| 5,476,043 | A | 12/1995 | Okuda et al. |
| 5,485,665 | A | 1/1996 | Marks et al. |

METHOD AND APPARATUS FOR SPIN PRINTING INDICIA ON PELLET SHAPED ARTICLES

This application is a continuation-in-part of application Ser. No. 09/059,205, filed Apr. 14, 1998.

BACKGROUND OF THE INVENTION

1. Field of Invention

This invention relates generally to a method and apparatus for orienting, positioning and spin printing indicia on pellet shaped articles, such as pharmaceutical capsules and the like. More specifically, the invention relates to a method and apparatus in which a conveyer transports the pellet shaped articles to a rotating printing drum that maintains the pellet shaped articles within pockets as the pellet shaped articles are passed through a printing station. The printing station has a movable printing roller capable of being moved toward and away from the printing drum or vice versa such that the printing roller accurately spin prints indicia onto the pellet shaped articles. A control unit is connected to the apparatus and is configured to control the location of the printing roller with respect to the rotating printing drum to adjust the amount of indicia transferred to the pellet shaped articles.

2. Description of Related Art

The concept of providing solid medication in unit doses for oral consumption is well known and commercially available wherever pharmaceutical products are sold. The medicinal compounds are packaged for consumption in various well known forms, such as tablets, caplets, capsules and others. The present invention is generally concerned with the orienting, rectifying, and precision spin printing of indicia onto pellet shaped articles.

The capsule is known as a common method of packaging medicinal compounds and other materials suitable for ingestion. Typically, the capsule is a two-part pellet shaped article having telescoping cap and body portions of predetermined size and configuration to hold the medicine therein, while caplets are shaped like capsules, but are one piece. Standard practice in the packaging of capsules is to imprint certain indicia over the surface of the capsules. The name of the manufacturer or the batch number from which the medicinal compound has been derived, or other information which may be required by the Food and Drug Administration, or other government agencies, are examples of the types of indicia found on capsules. The indicia can be imprinted onto the capsules by a technique known in the art as spin printing.

Spin printing is carried out by rotating the capsule on its longitudinal axis as indicia is printed on the surface of the capsule. Preferably, the capsules will be uniformly oriented or rectified before reaching the printing station. At the printing station, the capsules are then uniformly rotated in a manner which allows for rotation of the capsule without any substantial slippage between the imprinting head and the capsule surface, whereby a sharp, precise, printing indicia is produced on each capsule as it passes through the printing station.

Numerous methods and machines have been developed to spin print indicia onto pellet shaped articles, such as pharmaceutical capsules, food products, and the like. In general, there are two types of methods and corresponding apparatuses for spin printing. The first apparatus and method spin prints pellet shaped articles using a flat type carrier apparatus, e.g., conveyor belt, while the second apparatus and method spin prints onto the pellet shaped articles using rotating drums or cylinders.

The conveyor belt type spin printing apparatus, as shown in U.S. Pat. No. 3,871,295, for example, typically includes a feeding station 20, a transporting and rectifying member 21, a conveyance system 31, and a spin printing unit 41. The feeding station 20 usually comprises a gravity feed hopper located above the transporting member 21 and is designed to frictionally feed randomly ordered articles C into cavities 24 of the transporting member 21 in an orderly manner. The transporting member 21, which usually provides at least one rotating drum having a plurality of peripherally spaced cavities, rectifies the pellet shaped articles C while they are still in the cavities and deposits them in a predetermined and uniform manner onto the conveyance system 31.

The conveyance system, as shown in U.S. Pat. No. 4,632,028 for example, typically includes a carrier bar 45 having pockets 52 for holding the deposited articles 2 therein. The carrier bars 45 are conventionally composed of a slippery material, such as, for example, polytetraflouroethylene, having a coefficient of friction which is less than that of the printing roll in the spin printing unit. This composition allows the pellet shaped articles 2 to rotate freely upon their longitudinal axis when subjected to the frictional influence of the printing roll during the spin printing process. Before the articles are transported through the spin printing unit, some of the conveyor belt type spin printing devices use an apparatus for spacing apart the cap and body portions of the article to a limited degree in order to provide an enlarged and exact overall length for each pellet shaped article, thereby preparing each article for the spin printing operation.

For example, in U.S. Pat. No. 3,868,900, the cap and body portions are separated by using an air jet 72, known in the industry as an air separator. Once the articles are prepared for spin printing, they are transported further downstream to a spin printing unit. The conventional conveyor belt type spin printing unit also comprises an ink reservoir which applies ink to an etched roll. The etched roll transfers the indicia to a rubber printing roll which prints indicia onto each article as it passes through the printing unit while on the conveyance system.

Examples of the conveyor belt type of spin printing apparatus are disclosed in U.S. Pat. No. 3,868,900 to Ackley; U.S. Pat. No. 3,871,295 to Ackley; U.S. Pat. No. 3,931,884 to Ackley; U.S. Pat. No. 4,069,753 to Ackley, deceased et al.; U.S. Pat. No. 4,104,966 to Ackley, Jr. et al.; U.S. Pat. No. 4,167,226 to Ackley, decreased et al.; U.S. Pat. No. 4,254,704 to Ackley, Sr. et al.; U.S. Pat. No. 4,266,477 to Ackley; U.S. Pat. No. 4,335,810 to Ackley, deceased et al.; U.S. Pat. No. 4,372,437 to Ackley, Sr. et al.; U.S. Pat. No. 4,413,556 to Ackley; U.S. Pat. No. 4,479,573 to Ackley, Sr. et al.; and U.S. Pat. No. 4,632,028 to Ackley.

The rotating drum type spin printing apparatus, as shown in U.S. Pat. No. 4,377,971 for example, typically includes a feeding station, a plurality of rotating drums and a spin printing station. The feeding station 1 is similar to the one described in conjunction with the conveyor belt type spin printer and will not be discussed here. The rotating drums usually comprise at least two, and sometimes additional rotating drums. The first rotating drum 5, or transfer drum, receives the randomly ordered pellet shaped articles 3 into a plurality of peripherally spaced pockets 9 shaped and sized in a manner well known in the art to receive and carry individual pellet shaped articles 3. In general, a vacuum source 83 retains the pellet shaped articles 3 in the pockets 9 while a rotary brush 17 sweeps away any pellet shaped article 3 that may be overlapping the article-filled pocket. An arcuate sizing block and back guide 23, which is positioned circumferentially over the transfer drum 5 downstream of the feeding station 1 and upstream of the other drum 46, facilitates the rectifying of the pellet shaped articles 3 while in the peripherally spaced pocket 9 so that they are radially aligned within the pockets 9 of the transfer drum 5. Optionally, once the pellet shaped articles 3 are rectified, an air check may help to move the pellet shaped articles from the feed drum 5 to a second, or cam drum 46.

As shown in U.S. Pat. No. 3,889,591 for example, the second rotating drum 18 may also retain the pellet shaped articles T in peripherally spaced pockets 17*a* using a vacuum source 29. As mentioned with the transfer drum above and shown in U.S. Pat. No. 4,394,933 having three rotating drums, the second rotating drum 36 may also have a sizing block and back guide 44 that is positioned circumferentially over the second rotating drum 36 downstream of the transfer drum and upstream of the other drum, to facilitate the orienting of the pellet shaped articles 12 so that they are longitudinally aligned within the pockets 38 of the second rotating drum 36. The longitudinally aligned articles 12 are then transferred to a rotating printing drum 52.

The printing drum 52 maintains the pellet shaped articles 12 within peripherally spaced pockets 50*a* and rotates the articles 12 through a printing unit 58 where they are spin printed upon. It should be noted that while in the printing drum, the articles have been known to be held in place by a vacuum source. By keeping the pellet shaped articles in place, the vacuum source controls the amount the articles spin when they come into contact with the print roller. Since the print roller is rotating faster than the drum, the article "spins" in its pocket, thereby printing some indicia on the article. The spin printed articles are then discharged from the apparatus for further processing. Examples of the rotating drum type of spin printing apparatus are disclosed in U.S. Pat. No. 3,889,591 to Noguchi; U.S. Pat. No. 4,266,478 to Ackley; U.S. Pat. No. 4,369,702 to Ackley; U.S. Pat. No. 4,377,971 to Ackley; and U.S. Pat. No. 4,394,933 to Ackley.

Unfortunately, both types of spin printers suffer from drawbacks. One drawback to these types of spin printing devices is that there is no mechanism to accurately control the amount of pressure that is applied from the printing roll to the rotating article. Therefore, the existing types of spin printers apply too much or too little pressure to the article. When too much pressure is applied, the article rotates too fast within the pocket, and as such, will contact the printing roll an undesirable additional number of times. This relationship is known in the industry as kiss-back, which results in uneven and undesired indicia being printed onto the article. As a solution to this problem, some manufacturers cut-away the non-indicia transferring region of the printing roll to prevent kiss-back from occurring. However, this approach has proven to be too costly and results in the cut-away portion of the roll being wasted. An additional drawback is that the printing roll must be changed for different indicia logos. Also, because the above-described types of spin printing devices are not capable of controlling the amount of pressure applied to the article, the devices cannot print a band of indicia completely around the article such that the ends of the indicia bands are registered. Further, conventional spin printers have the drums and printing roller geared to one another, which does not allow for the relative speed changes. At present, the current spin printing apparatuses are capable of printing a band of indicia on the article encompassing approximately 310° to 320° around the article. In addition, existing spin printing apparatuses are incapable of adjusting the speed of rotation of the printing roller relative to the printing drum, the amount of pressure applied to the articles from the printing roller, the location of the printing roller and articles relative to each other and/or the amount of indicia applied to the articles "on the fly," or in other words, while the apparatus is operating.

SUMMARY OF THE INVENTION

It is an object of the invention to provide a spin printing apparatus and method for accurately spin printing indicia on pellet shaped articles.

It is another object of the invention to provide a spin printing apparatus and method that is capable of marking the pellet shaped articles or capsules completely around the objects such that the ends of the indicia bands meet.

In order to achieve the above, and to overcome the shortcomings in the aforementioned related art, a spin printing method and apparatus according to a preferred embodiment of the invention includes a conveyor and a printing roller. The conveyor has a plurality of pockets that receive a plurality of pellet shaped articles. The printing roller is spaced a predetermined distance from the conveyor and prints indicia on each of the pellet shaped articles. The apparatus further includes a device that adjusts the predetermined distance to change the amount of indicia that is printed onto the pellet shaped articles. Optionally, the conveyor may have a pocket for receiving a pellet shaped article.

Preferably, the conveyor includes a printing drum rotatably communicating with the printing roller. The printing drum has a vacuum source that maintains the pellet shaped articles within a plurality of pockets by drawing air into the pockets such that the pellet shaped articles are maintained in the pockets. The pellet shaped articles are spin printed upon as they pass the printing roller. Optionally, a feeding station may be configured to distribute the pellet shaped articles onto the printing drum before they are spin printed.

The conveyor of the apparatus may further include a pick-up drum and a positioning drum. Each drum would also have a plurality of pockets that receive the plurality of pellet shaped articles. The pick-up drum rotatably communicates with and receives the pellet shaped articles from a feeding station, while the positioning drum rotatably communicated with and received the pellet shaped articles from the pick-up drum. As such, the printing drum would then rotatably communicate with and receive the pellet shaped articles from the positioning drum.

A design roller, defining a pattern of indicia, is in constant contact with the printing roller. The printing roller is positioned between the design roller and the printing drum and rotatably communicates with both. As such, because the printing roller has a smooth, blank surface, the printing roller transfers the pattern of indicia from the design roller to the pellet shaped articles, which are held in the printing drum. In addition, the printing roller is movable toward and away from the printing drum.

Alternatively, the device could be a control unit that is connected to the printing roller such that the control unit controls the precise location of the printing roller with respect to the conveyor or printing drum. By adjusting the distance of the printing roller from the conveyor, when the printing roller is positioned closer to the conveyor, the amount of indicia printed on the pellet shaped articles increases. Contrarily, when the printing roller is positioned farther from the conveyor, the amount of indicia printed on the pellet shaped articles decreases. The design roller and associated ink pan can be designed to move with the printing roller.

Optionally, the control unit can also control the location of the conveyor with respect to the printing roller. Therefore, when the conveyor is positioned closer to the printing roller, the amount of indicia printed on the pellet shaped articles increases, and when the conveyor is positioned farther from the printing roller the amount of indicia printed on the pellet shaped articles decreases.

The resulting apparatus selectively spin prints indicia onto each of the pellet shaped articles encompassing a range of 0° to 360° of the circumference of the pellet shaped articles.

In another embodiment, an apparatus has a conveyor, a printing roller that provides a predetermined amount of indicia to the pellet shaped articles under a selected force and a control unit that adjusts the selected force to change the predetermined amount of indicia provided onto the pellet shaped articles. The apparatus includes a printing drum, pickup drum, positioning drum, and design roller.

The control unit can control the precise location of the printing roller with respect to the conveyor or printing drum such that the selected force applied to the pellet shaped articles can be adjusted. Therefore, when the printing roller is positioned closer to the printing drum, the selected force provided to the pellet shaped articles increases and the amount of indicia provided from the printing roller to the pellet shaped article also increases. When the selected force is decreased, the amount of indicia provided from the printing roller to the pellet shaped article will also decrease.

Optionally, the control unit can be connected to the conveyor to control the precise location of the conveyor with respect to the printing roller. As such, the servo controller can adjust the selected force provided to the pellet shaped articles from the printing roller. By positioning the conveyor closer to the printing roller, the amount of indicia provided from the printing roller to the pellet shaped article increases because the selected force is increased. In addition, when the conveyor is moved away from the printing roller, the selected force is decreased and the amount of indicia provided to the pellet shaped article also decreases.

In yet another embodiment, an apparatus has a printing roller that frictionally engages the pellet shaped articles to selectively print a standard amount of indicia along the entire circumference of the capsule. The apparatus has a conveyor and control unit that adjusts the amount the printing roller frictionally engages the pellet shaped articles.

In another embodiment, an apparatus has a printing roller having a predetermined rate of rotation to selectively spin print indicia along an entire circumference of the pellet shaped articles. The apparatus also has a control unit or any other suitable variable drive device that adjusts the rate of rotation of the printing roller, for example, relative to the associated printing/position drums, to change the amount of indicia spin printed on the pellet shaped articles. The conveyor may include a pick-up drum, positioning drum and printing drum that are synchronized with each other and rotate at a rate slower than the printing roller.

The control unit may control the precise location of the printing roller with respect to the conveyor and/or the rate of rotation of the printing roller. So, when the printing roller is moved closer to the printing drum, the amount of indicia spin printed on the pellet shaped articles increases, and when the printing roller is moved away from the conveyor, the amount of indicia spin printed on the pellet shaped articles decreases. Also, when the rate of rotation of the printing roller is increased, the amount of indicia spin printed onto the pellet shaped articles increases.

Preferably, the spin printing is accomplished with a smooth, blank printing roller that rotatably communicates with the design roller. Since the design roller defines a pattern of indicia on its circumference, the printing roller transfers the indicia on the design roller to the pellet shaped articles.

Some embodiments of the invention include a detection unit that automatically detects information associated with a length of a band of indicia that is printed onto the pellet shaped articles. In these embodiments, the adjustment of the printing roller speed, position and/or contact force with respect to the conveyor may be adjusted based on the detected information.

The detection unit may include a rotation mechanism that rotates pellet shaped articles about a longitudinal axis of the pellet shaped articles, and either a video camera or a photo sensor that obtains optical information from a peripheral surface of the one of the pellet shaped articles while the one of the pellet shaped articles is rotating. Pattern recognition may be used to identify a pattern of the indicia. The optical information may include an actual length of the band of indicia, a length of a blank space between an ending point of the band of indicia and a beginning point of the band of indicia, whether any unrecognizable characters are present in the band of indicia, and/or whether a pattern of the indicia matches a stored target pattern.

The resulting apparatus and method accurately spin prints indicia onto pellet shaped articles. In addition, the band of indicia printed on the articles may completely surround the article if desired, thereby providing a pleasing appearance not previously possible and the consumer with more information as to the nature of the contents within the article that they are consuming.

These and other objects of the invention will be described in or apparent from the following description of preferred embodiments.

BRIEF DESCRIPTION OF THE DRAWINGS

Preferred embodiments of the invention will be described in conjunction with the following drawings in which like reference numerals designate like elements and wherein.

DETAILED DESCRIPTION OF PREFERRED EMBODIMENTS

Figure 1:
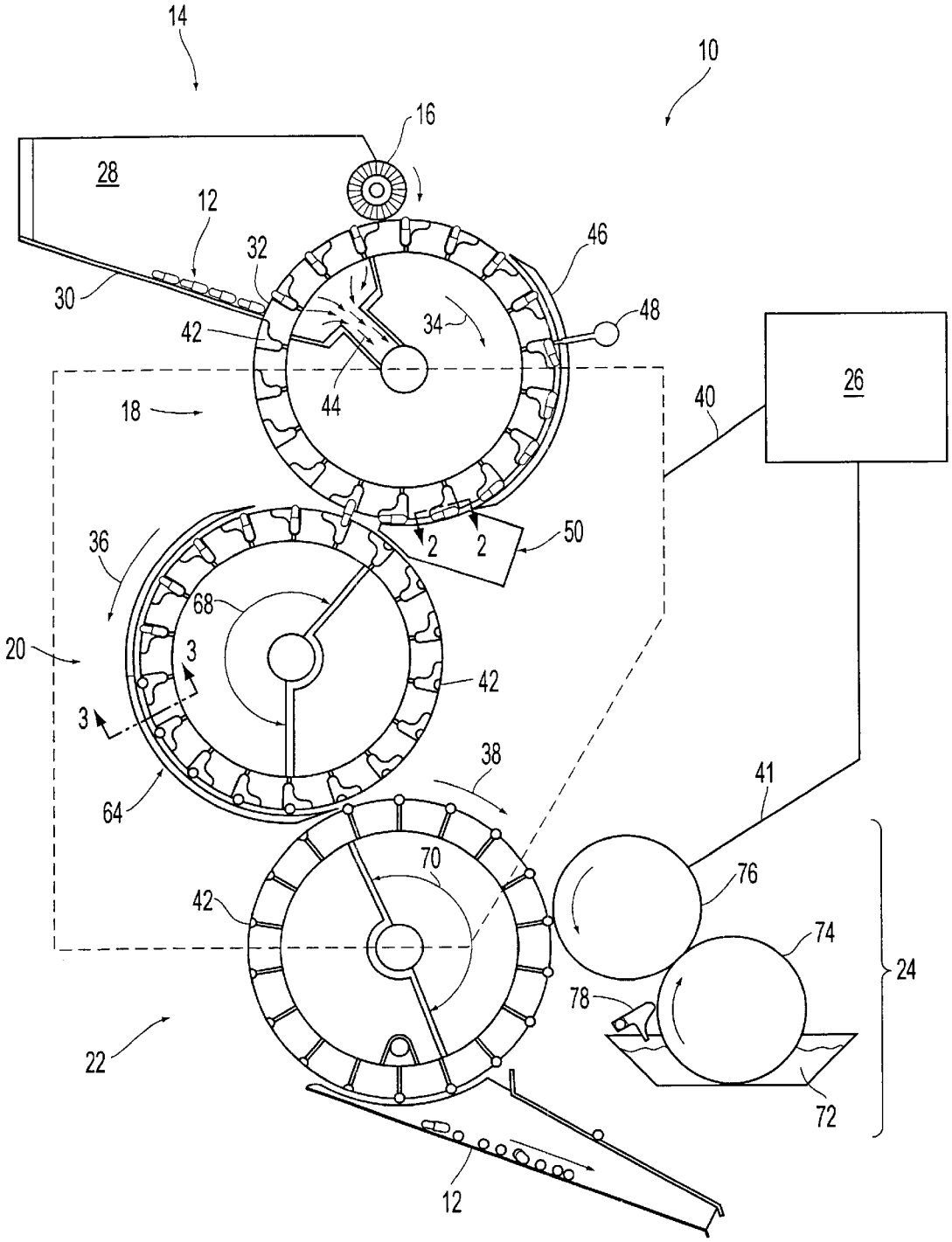
FIG. 1 is a cross-section view of the spin printing apparatus for printing indicia on pellet shaped pharmaceutical articles.

FIG. 1 is a cross section view of an apparatus 10 for accurately spin printing indicia onto pellet shaped pharmaceutical articles 12 such as, for example, capsules. The apparatus 10 includes, for example, a feeding station 14, a rotary brush 16, a pick-up drum 18, a positioning drum 20, a printing drum 22, a printing station 24, and a control unit 26. The pick-up drum 18, positioning drum 20, and pick-up drum 22 rotate and are synchronized with each other to effectively and efficiently orient and rectify a plurality of randomly ordered articles 12 for spin printing.

Figure 9:
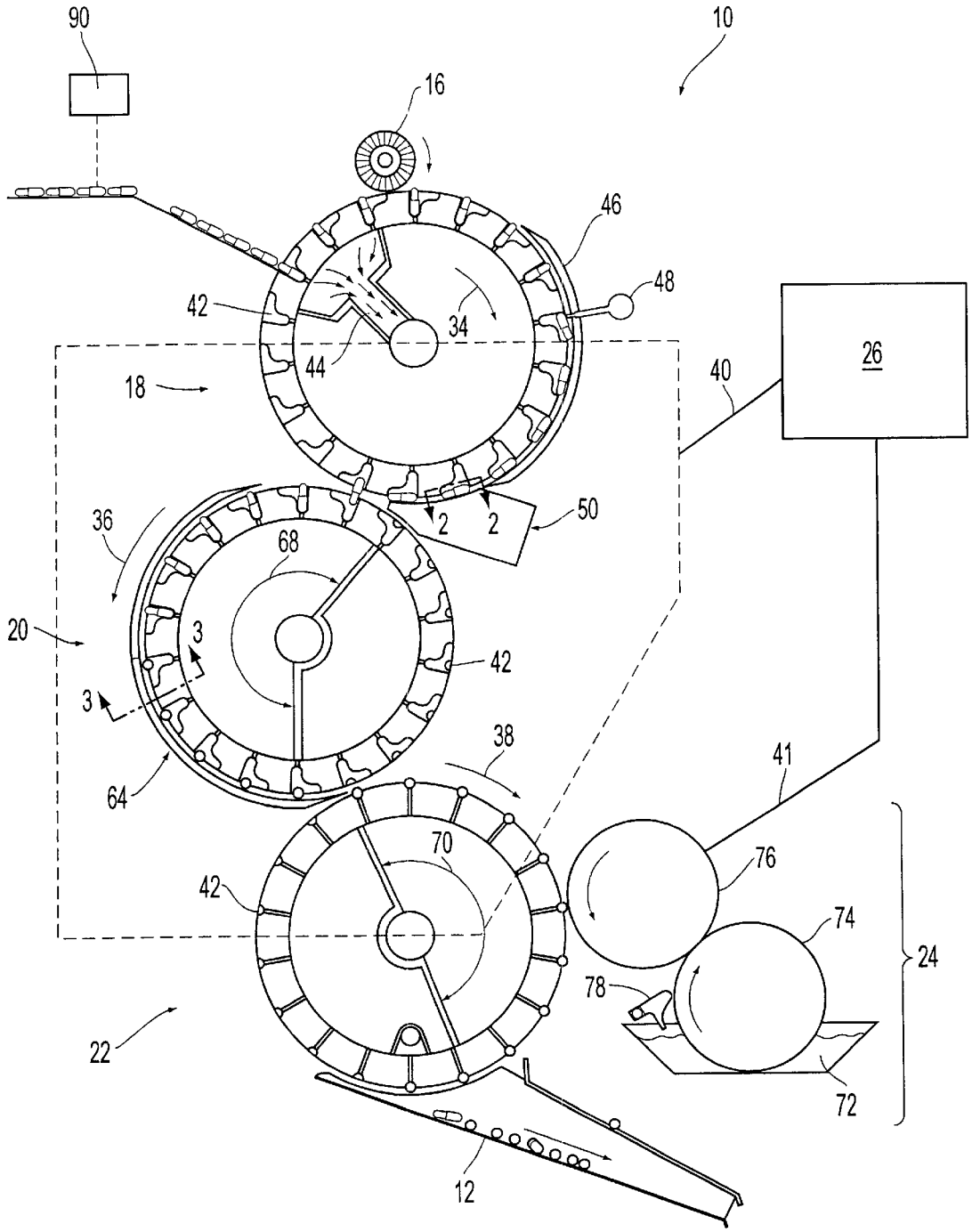
FIG. 9 is a cross-section view of the spin printing apparatus in a third embodiment according to the invention.

The feeding station 14 is mounted upon a suitable support (not shown) and includes, e.g., a hopper 28 having an inclined bottom 30 terminating at an article opening 32 that feeds the randomly ordered pellet shaped articles 12 one at a time into the pick-up drum 18. As can be seen in FIG. 1, the inclined bottom 30 is designed to radially feed the articles 12 into the pick-up drum 18. It should be noted that the inclined bottom 30 may also be designed to feed the pellet shaped articles 12 longitudinally (not shown) into the pick-up drum 18 to have the feeding station 14 be a flat conveyer (not shown). It is also within contemplation of the invention to have the feeding station 14 be a flat conveyor as shown in FIG. 9.

The pick-up drum 18 is rotated by its shaft in a direction indicated by the arrow 34. The positioning drum 20 rotates in a substantially tangential relationship below the pick-up drum 18 in the direction of the arrow 36 upon rotation of its shaft. The printing drum 22 also rotates in a substantially tangential relationship beneath the positioning drum 20 in the direction of the arrow 38 upon rotation of its affixed shaft. The control unit 265 may be connected to one or more drive devices (not shown), such as motors, that cause the drums to rotate. The drive devices may be ordinary motors, or may be more specialized devices such as servomechanisms. In the context of this disclosure, a servomechanism includes a sensing element and a motor. A servomechanism provides feedback to the controller, and thus allows automatic control of the motor by the control unit 26 based on the feedback. The motor(s), drums and control unit 26 may be interconnected as necessary by a timing belt (not shown), gear train (not shown) and/or the like arranged in a manner known in the industry to allow the control unit 26 to control the rotation speed of the drums. Thus, the controller 26 controls the rotation speed of all of the drums such that the drums have the same rotation speed.

The articles 12 are radially fed from the hopper 28 to the pick-up drum 18 into pockets 42 on the periphery of the pick-up drum 18. The pockets 42 are sized and shaped to receive individual articles 12 therein. A vacuum source 44, which may or may not be controlled by the control unit 26, can be provided to draw the individual articles 12 snugly into each pocket 42 and a hopper brush 16 sweeps away any articles 12 that may be overlapping an occupied pocket 42. Once any overlapping articles 12 have been swept away by the hopper brush 16, the vacuum source 42 is terminated and the articles 12 are maintained in their respective pockets 42 by gravity and/or an arcuate sizing block and back guide 46. The positioning drum 20 and printing drum 22 may also include internal vacuum sources 68 and 70, respectively.

The arcuate sizing block and back guide 46, positioned circumferentially over the pick-up drum 18 downstream of the hopper 28 and upstream of the positioning drum 20, initiates alignment of the pellet shaped articles 12 so that they may eventually be rectified in a uniform radial alignment within the pockets 42 of the pick-up drum 18. An air jet 48 is located proximate the top of the back guide 46 to help dislodge the articles 12 from the pockets 42 so that they may be eventually rectified properly.

Figure 2:
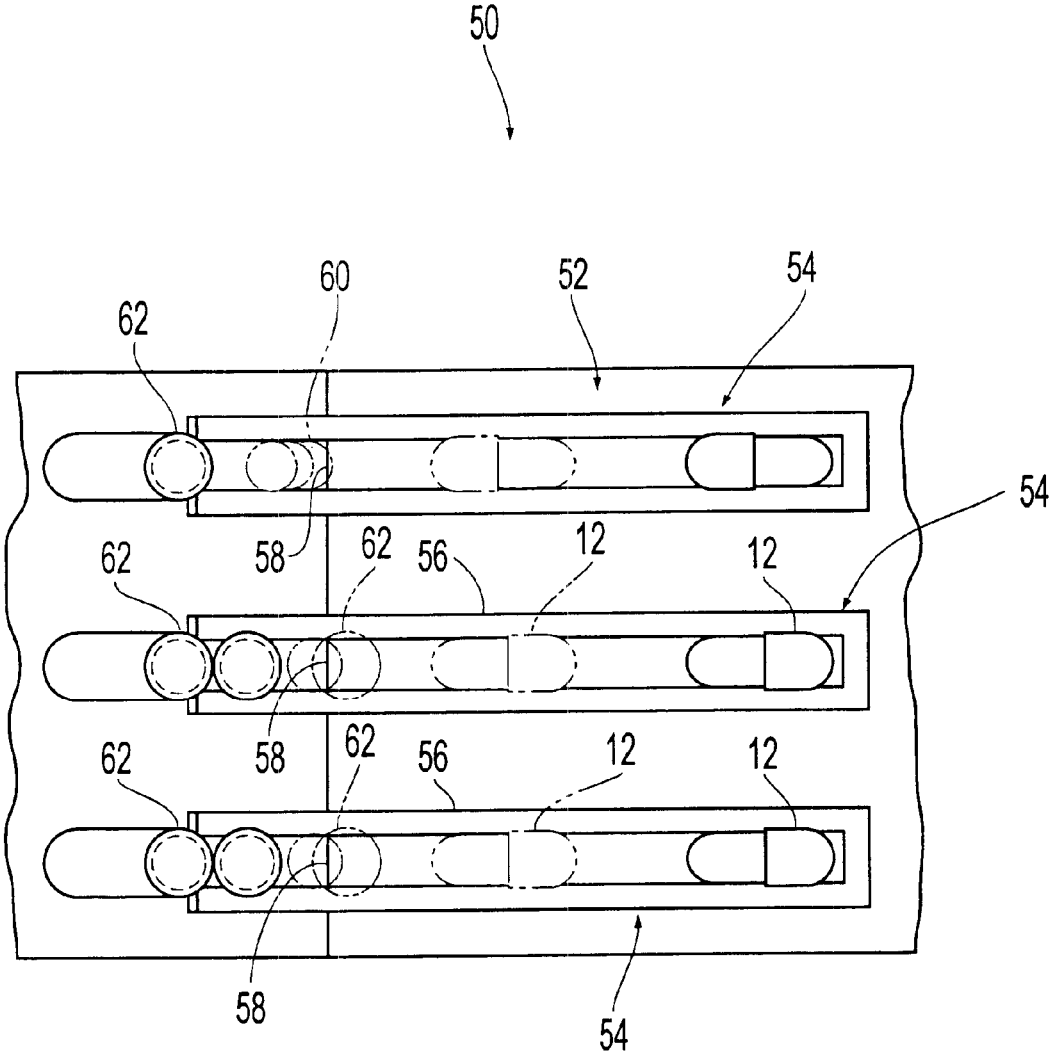
FIG. 2 is a cross-sectional view of the apparatus illustrated in FIG. 1, as viewed along line 2—2, showing the article rectifier.

With reference to FIG. 2, the base of the pick-up drum 18 is provided with a rectifier 50, which generally includes a guide 52 incorporating one or more channels 54. Each channel 54 of the guide 52 is in alignment with each row of pockets 42 on the periphery of the pick-up drum 18. In the example shown, three rows are provided, but more or less rows are obviously within contemplation. Each of the channels 54 is defined by spaced walls 56 which project from the terminating edge 58 of the guide 52 so that the end of each channel 54 is open at the bottom.

The channels 54 are configured to have a width designed to receive the body portion 60 of the article 12, but not the cap portion 62. Therefore, any article 12 which is contained in the peripheral portion of a pocket 42, such that the body portion 60 leads the cap portion 62, will be received within the guide 52 so the article 12 can rotate about a horizontal axis within the channel 54, such that the article 12 is suspended between the walls 56 of the channel 54 by its cap portion 62. Articles 12 that are contained in the peripheral portion of a pocket 42 such that the cap portion 62 leads the body portion 60 will proceed along the channel 54 until the body portion 60 is drawn beyond the edge of the guide 52, whereupon such articles 12 will also rotate about a horizontal axis within the channel 54, so that the article 12 is again suspended from the walls 56 of the channel 54 by its cap portion 62. After traversing the guide 52, the articles 12 are then delivered to a positioning drum 20 in uniform radial alignment.

Returning to FIG. 1, the radially aligned articles 12 are then transferred to a rotating positioning drum 20 that is synchronized with the pick-up drum 18. The positioning drum 20 also has a plurality of peripherally spaced pockets 42 sized and shaped to receive and transport the individual pellet shaped articles 12. As can be seen in FIG. 1, the articles 12 are received in a radial position by the pockets 42 of the positioning drum 20.

Figure 3:
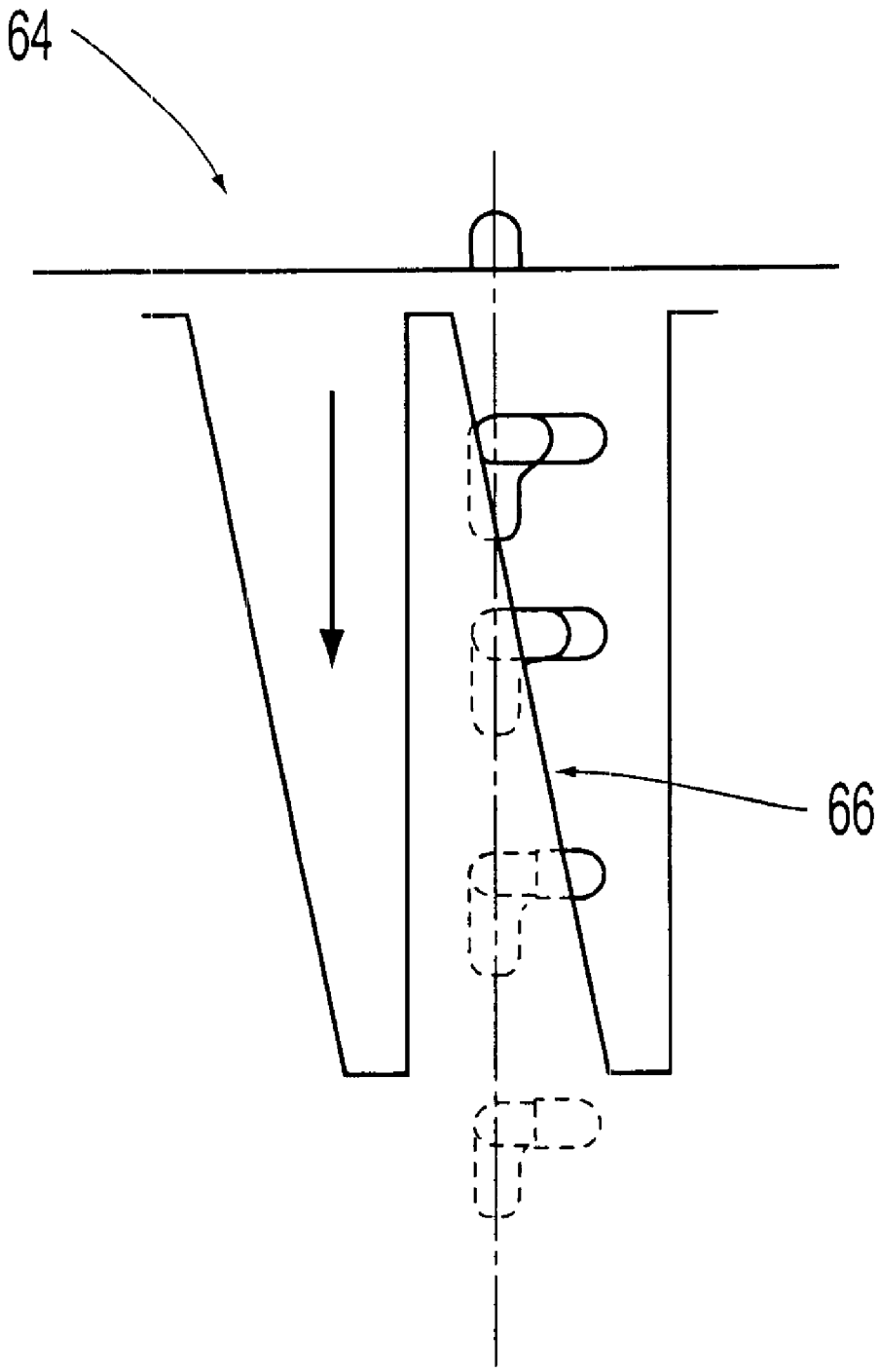
FIG. 3 is a cross-sectional view of the apparatus of FIG. 1, as viewed along line 3—3.

As shown in FIG. 3, a cam edge 64, having a back guide with cam track 66 and being positioned circumferentially over the positioning drum 20 downstream of the pick-up drum 18 and upstream of the printing drum 22, orients the articles 12 so that they are longitudinally aligned within the pockets 42 of the positioning drum 20. A vacuum source 68 and/or gravity retains the articles 12 within the individual pockets 42 from when they are deposited from the pick-up drum 18 to the positioning drum 20 to when the articles 12 are dislodged and transferred to the printing drum 22. As the positioning drum 20 rotates, the vacuum source 68 maintains the radially aligned articles 12 within their respective pockets 42. As can be seen in FIG. 3, when the articles 12 engage the cam edge 64, the cam track 66 manipulates the articles 12 from a radial alignment to a longitudinal alignment so that indicia may be imprinted upon the circumferential surface of the article. Once the articles 12 have been longitudinally aligned, they are deposited within the peripherally spaced pockets 42 of the rotating printing drum 22 that is synchronized with the positioning drum 20.

The printing drum 22 receives the longitudinally aligned articles 12 within the pockets 42 which are maintained therein by a vacuum source 70. The vacuum source 70 retains the articles 12 within the pockets 42 as they pass through the spin printing station 24.

The spin printing station 24 generally includes an ink pan 72 having a design or gravure roller 74 rotating therein and a movable printing roller 76 positioned between the design roller 74 and the rotating printing drum 22. The design roller 74 has a logo etched onto its peripheral surface such that when the control unit 26 manipulates the printing roller 76 to be in simultaneous contact with the design roller 74 and the printing drum 22, ink is transferred from the design roller 74 to the printing roller 76. A doctor blade 78 is positioned between where the design roller 74 picks up the ink and transfers it to the printing roller 76 to remove any excess ink. The printing roller 76 may be blank in that there would be no logos or other indicia permanently etched onto the roller 76. This would allow the same printing roller 76 to be used for subsequent jobs having different indicia. The design roller 74, being in contact with the printing roller 76, transfers the ink to the printing roller 76 so that it can be printed onto the pellet shaped articles 12 maintained in the peripherally spaced pockets 42 of the printing drum 22.

Because the vacuum source 70 uses a constant holding pressure to maintain the articles 12 within their respective pockets 42 of the rotating printing drum 22, the control unit 26 dictates the amount of ink imprinted onto the articles 12 by controlling the positioning of the printing roller 76 relative to the design roller 74 and the rotating printing drum 22 such that the amount of impression, or contact, between the printing roller 76 and the printing drum 22 directly correlates to the length of the band of indicia imprinted onto the articles 12. The relationship between the design roller 74, printing roller 76 and printing drum 22 is such that the further inward the printing roller 76 is positioned, i.e., closer to the printing drum 22 and farther from the design roller 74, the more ink that will get printed onto the article. This is due to the fact that the amount of frictional pressure applied to the article from the printing roller 76 will increase, resulting in the pellet shaped article 12 spinning more within the pocket 42 as it is being maintained therein by the vacuum source 70.

Conversely, the further outward the printing roller 76 is positioned, i.e., closer to the design roller 74, and further from the rotating printing drum 22, a smaller amount of ink is printed onto the article because the article 12 will spin less because less pressure is applied to the article 12 and the circumference needed to be traversed by the printing roller 76 is larger. Of course, the design roller 74 and/or ink pan 72 can move with the printing roller 76 to maintain contact between the design roller 74 and the printing roller 76.

The control unit 26 may also be programmed to coordinate relative movement between the printing drum and printing roller based on the printing cycle of the system. The control unit 26 would be capable of moving the printing drum and roller toward one another during printing, and to move them away from each other during non-printing periods, which also prevents a solution to "kiss-back". The cycling can be effected by, for example, software programming and/or a mechanical device such as a cam mechanism.

Referring back to FIG. 1, it can be understood that the control unit 26 may be connected 40 to the pick-up drum 18, positioning drum 20 and printing drum 22 electrically, mechanically, digitally, optically or by any other known or later-developed method. As such, the control unit 26 can be used for adjusting the timing the transfer of the pellet shaped articles 12 from the pick-up drum 18 to the positioning drum 20. By adjusting the speed of the rotating drums, the control unit 26 allows the apparatus to handle various types of pellet shaped articles consistently. For example, if the apparatus 10 completes a job spin printing large articles and is going to handle smaller articles on a subsequent job, the control unit 26 can adjust the speed of the rotating drums to take into account the characteristics of articles to be spin printed during the subsequent job. As such, the control unit 26 may be used for adjusting the set up or home position of the pick-up drum 18 as well as setting the speed of the apparatus 10. It is also within contemplation that the control unit 26 may be connected to only selected ones, e.g., less than all of the rotating drums. For example, the control unit 26 may be connected to just the pick-up drum where the remaining drums would be controlled by the pick-up drum 18 in a master/slave relationship.

Figure 4:
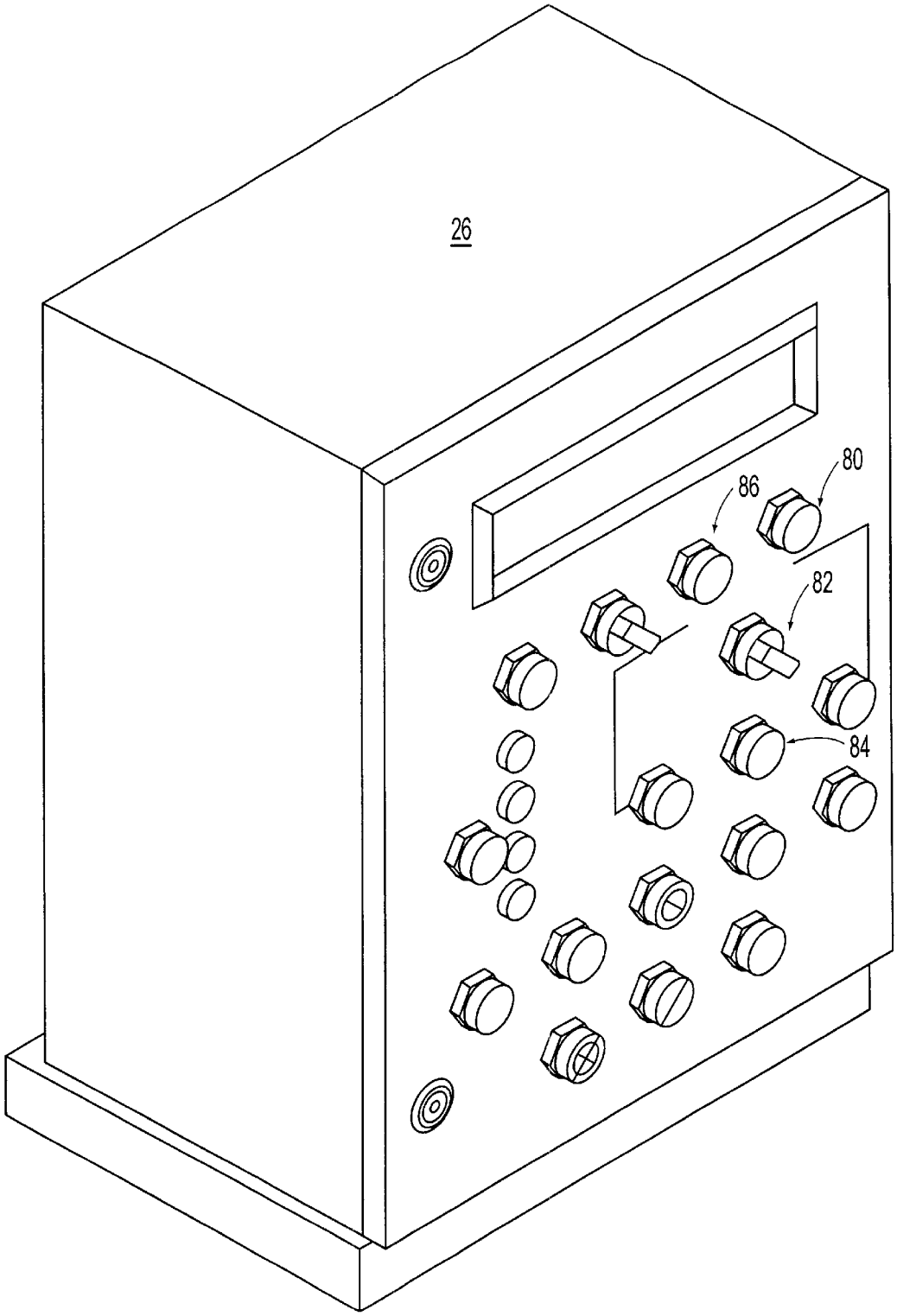
FIG. 4 is a perspective view of the control unit of the apparatus of FIG. 1.

Looking at FIG. 4, it can be understood that numerous buttons on the control unit 26 allow a user to establish the apparatus 10 parameters for a specific job. Among the numerous buttons is a START button 80 which will begin operation of the apparatus 10. It should be noted that once the START button 80 is engaged, the apparatus 10 will "home" itself before beginning operation. In addition, certain buttons may be used to increase or decrease the speed or position of the function selected. For example, while the apparatus 10 is running, a user may wish to increase the rotation speed of the drums. In order to do this, the user merely needs to identify the function desired to be adjusted and engage the designated buttons which will incrementally adjust the selected function, in this example, the speed, until the function performs at the desired level.

Returning to FIG. 1, it can be understood that the control unit 26 is also connected by a connection 41 to the printing roller 76 electrically, mechanically, digitally or by any other method. The connection 41 provides the control unit 26 with the ability to incrementally adjust the location of the printing roller 76 with respect to the rotating printing drum 22, the speed of rotation of the printing roller, or the location and speed of rotation to change the amount of indicia that is transferred to the pellet shaped articles 12. For example, a fine-coarse feature 84 of the control unit 26 can establish the distance that the printing roller 76 will move when an Advance (+)/Retard(−) button 86 is engaged. When so desired, the printing roller 76 can be advanced in the same direction as its travel, i.e., toward the printing drum 22, or opposite its direction of travel, i.e., away from the printing drum 22.

Now, looking at FIGS. 5(*a*)-(*c*), the relationship between the placement of the printing roller 76 and the length of the printed band of indicia on the pellet shaped articles 12 will be explained further.

The articles 12 are maintained in their respective pockets 42 by the holding force of the vacuum source 70. However, since the vacuum source 70 is not necessarily controlled by the control unit 26 and the holding force is constant, manipulating the degree of contact between the printing roller 76 and the vacuum retained article 12 allows for a precise amount of indicia to be printed onto the article 12. Also, the speed of rotation of the printing roller 76, and consequently the article 12, can be adjusted while the apparatus 10 is running or "on the fly." The precise positioning of the printing roller 76 can be adjusted by the control unit 26 to set the amount of frictional pressure necessary to be applied to the articles 12 so that the articles 12 will rotate and a band of indicia printed thereon. If desired, the printing roller 76 positioning and hence the amount of frictional pressure can be set such that the band of indicia completely encompasses the article 12.

Figure 5A:
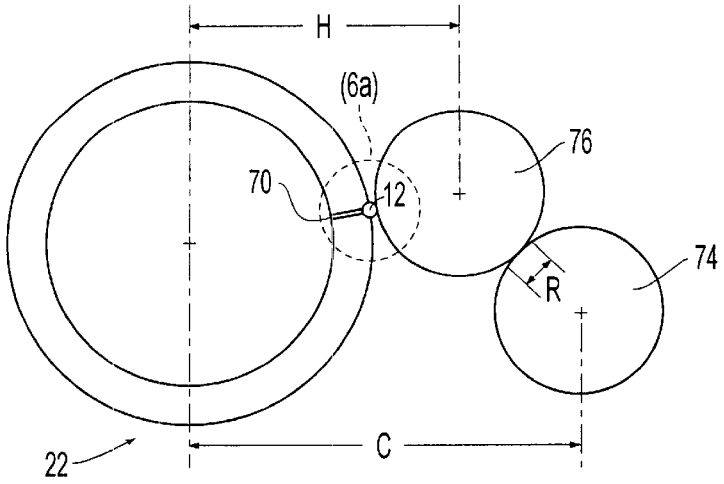
FIGS. 5(*a*)-(*c*) are schematic views of the design roller, printing roller and printing drum of the apparatus of FIG. 1, illustrating the relationship between the placement of the printing roller and the length of the printed band of indicia.
Figure 5B:
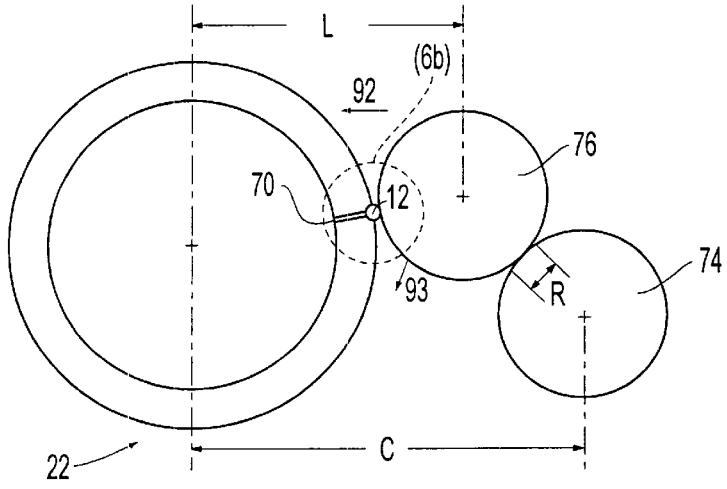
Figure 5C:
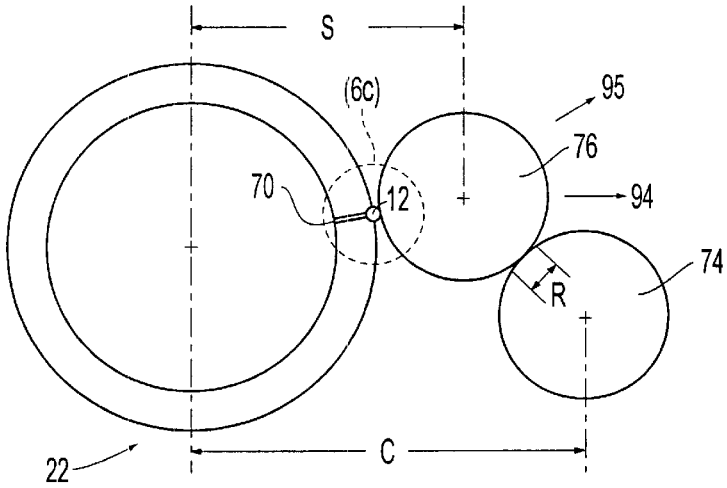

As shown in FIG. 5(*a*), the printing roller 76 is in its home position, where the distance H represents a standard predetermined amount. The pressure between the printing roller 76 and the printing drum 22 is a predetermined, standard amount when the printing roller is in the home position. Although the printing drum and design, roller rotate, because they do not move in axial or radial directions relative to their respective shafts, it can also be appreciated that the distance C between the design roller 74 and the printing drum 22 remains constant. This is true except for the apparatus configuration where the design roller 74 moves with the printing roller 76.

Figure 6A:
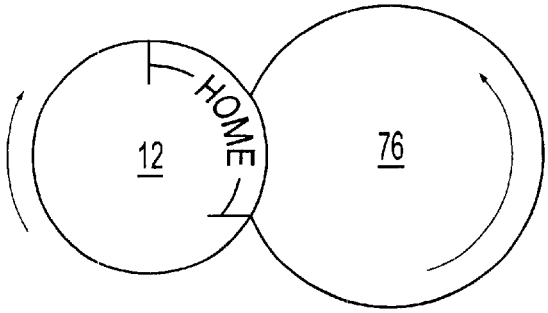
FIGS. 6(*a*)-(*c*) depict examples of the relationship in FIGS. 5(*a*)-(*c*) in enlarged views.
Figure 6B:
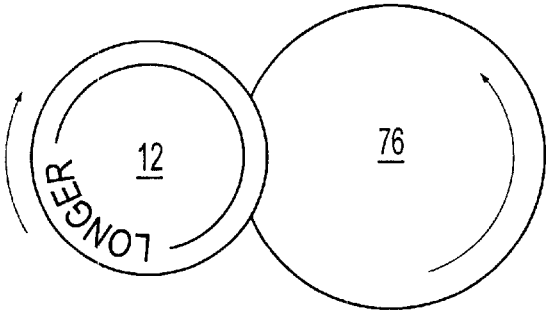
Figure 6C:
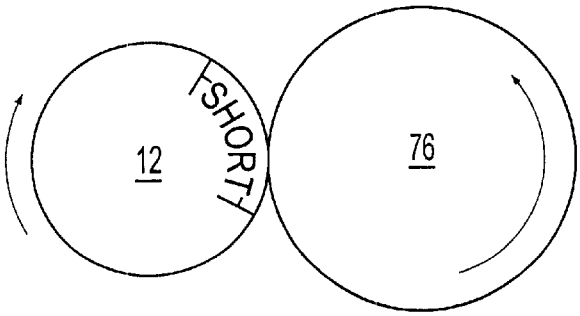
Figure 7A:
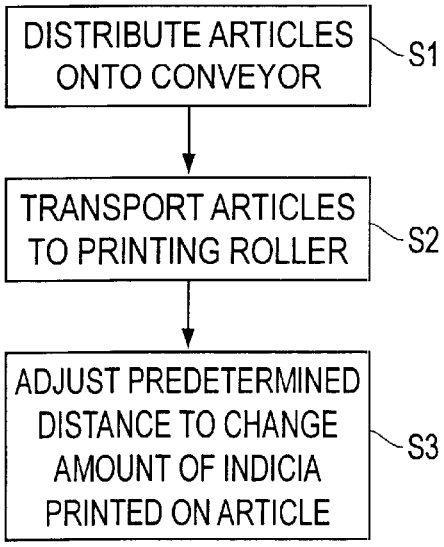
FIGS. 7(*a*)-(*d*) depict flowchart diagrams for methods of rectifying, orienting, and printing indicia onto pellet shaped pharmaceutical articles using the apparatus of FIG. 1.
Figure 7C:
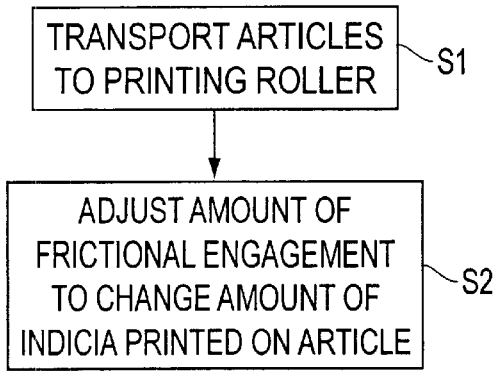
Figure 7B:
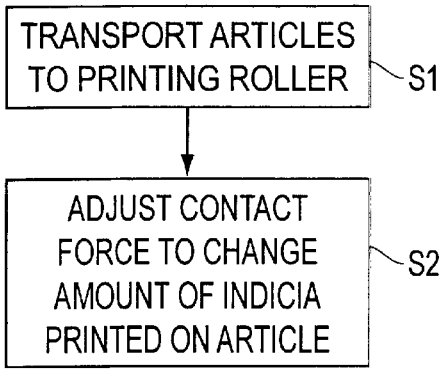
Figure 7D:
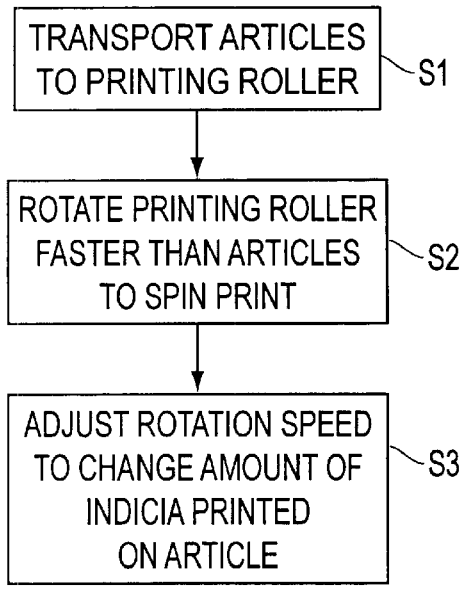

Now turning to FIG. 6(*a*), an example of an article 12 being spin printed upon while the printing roller 76 is positioned in the home setting will be described. As discussed above, the article 12 is maintained in its respective pocket 42 by a constant holding force from a vacuum source 70 within the printing drum 22. The article 12 is consequently rotating very little, if at all. The printing roller 76 is rotating faster than the printing drum 22 such that when the printing roller 76 makes contact with the article 12, a frictional pressure is applied to the article 12. The article 12 is then forced to rotate within its pocket 42 and against the holding force, while simultaneously indicia is transferred from the printing roller 76 to the rotating, or spinning, article 12. The length of the band of indicia directly corresponds to the amount of contact the printing roller 76 has with the article 12. The closer the printing roller 76 is to the printing drum 22, the more contact it will have with the article 12 and the longer the band of indicia.

Now looking at FIG. 5(*b*), an example of when the distance between the printing roller 76 and the printing drum 22 is shortened relative to the standard predetermined distance H will be described, to increase the length of the band printed. For example, to have the band of indicia printed completely around the article 12, the printing roller 76 will be advanced toward the printing drum 22 as indicated by the arrow 92 such that distance L is less than the distance H discussed above. In addition to moving the printing roller 76 closer to the printing drum 22 in the direction indicated by arrow 92, the printing roller 76 is also moved toward the printing drum 22 in a direction indicated by arrow 93. Thus, looking at FIGS. 5(*a-c*) it can be seen that the printing roller 76 maintains a constant amount of contact R with the design roller 74 at all times. In other words, regardless of the length of the indicia to be transferred to the pellet shaped articles, the printing roller 76 and design roller 74 will always contact each other the same amount R. This assures that the amount of indicia to be transferred to the articles 12 will not be affected by the positioning of the printing roller 76. Yet, moving the printing roller 76 closer to the printing drum 22 will increase the amount of contact the printing roller 76 has with the articles 12 within the printing drum 22. As can be seen in FIG. 6(*b*), the increase in the amount of contact leads to a longer band of indicia being printed onto the circumference of the article 12.

The printing roller 76 is moved closer to the printing drum 22 by advancing the Advance/Retard button 86 on the control unit 26 once the fine-coarse feature 84 has been selected. Engaging the Advance/Retard button 86 will incrementally move the printing roller 76 a predetermined or user-determined amount, thereby increasing the amount of contact between the printing roller 76 and the printing drum 22. Also, because the printing roller 76 rotates faster then the printing drum 22, the article 12 will spin faster within its pocket 42. Therefore, the circumference of the article 12 is more completely and quickly exposed to the printing roller 76, thereby resulting in a band of indicia, for example, being imprinted onto the article 12 completely around the circumference of the article 12, as shown in FIG. 6(*b*).

Now looking at FIG. 5(*c*), an example of when the band of indicia is desired to be shorter than the Home setting will be described. To decrease or shorten the band of indicia, the printing roller 76 is moved away from the printing drum 22 in a direction indicated by the arrow 94, increasing the distance S between the printing roller 76 and printing drum 22 such that distance S is more than distance H discussed above, thereby decreasing the amount of contact the printing roller 76 has with the articles 12. This results in a decrease in the amount of pressure being applied to the articles 12 from the printing roller 76. Therefore, the band of indicia printed on each article 12 is shorter, as shown in FIG. 6(*c*).

As can be appreciated in view of the above discussion, various buttons on the control unit 26 can be designated for printing indicia on the articles 12 in predetermined circumferential amounts, e.g., one button for 90° printing, another button for about 120° printing, and other buttons for increments covering printing over a range of about 121°-360°.

FIGS. 7(*a*)-(*d*) explain different methods, aspects of which are combinable, in using the apparatus for orienting, positioning and spin printing indicia onto pellet shaped articles 12.

Looking at FIG. 7(*a*), step 1 of the method entails distributing the pellet shaped articles 12 onto a moving conveyor. The conveyor includes at least the printing drum 22 and possibly additional drums. Step 2 involves transporting the pellet shaped articles 12 to a printing roller 76 positioned a predetermined distance H from the conveyor. Step 3 includes adjusting the predetermined distance H of the printing roller 76 to the conveyor, thereby changing the amount of indicia printed onto the pellet shaped articles 12.

FIG. 7(*b*) depicts another method in using the apparatus. Step 1 of the method involves transporting the pellet shaped articles 12 to a printing roller 76 that transfers indicia to the pellet shaped articles under a contact force. Step 2 entails adjusting the contact force to change the amount of indicia transferred to the circumference of the pellet shaped articles.

FIG. 7(*c*) shows yet another method in using the apparatus. Step 1 of the method entails transporting the pellet shaped articles 12 to the printing roller 76 that transfers an amount of indicia onto the entire circumference of the pellet shaped articles 12 by frictionally engaging the pellet shaped articles 12. Step 2 includes adjusting the amount the printing roller 76 frictionally engages the pellet shaped articles 12 to change the amount of indicia transferred to the pellet shaped articles 12.

FIG. 7(*d*) depicts another method in using the apparatus. Step 1 involves transporting the pellet shaped articles 12 to the printing roller 76. Step 2 includes rotating the printing roller 76 faster than the pellet shaped articles 12, thereby transferring an amount of indicia onto the entire circumference of the pellet shaped articles 12. Step 3 entails adjusting the speed of the printing roller 76 relative to the various drums/conveyor to change the amount of indicia transferred to the pellet shaped articles 12. In this embodiment, the controller could also be any suitable variable drive device that is capable of adjusting the speed of the printing roller relative to the speed of the conveyor/printing drum.

The various methods described above also have aspects that are combinable with one another. For example, the control unit or other suitable controller can be used to change the distance between the primary drum and printing roller, as well as change the speed of the printing roller with respect to the printing drum.

Figure 8:
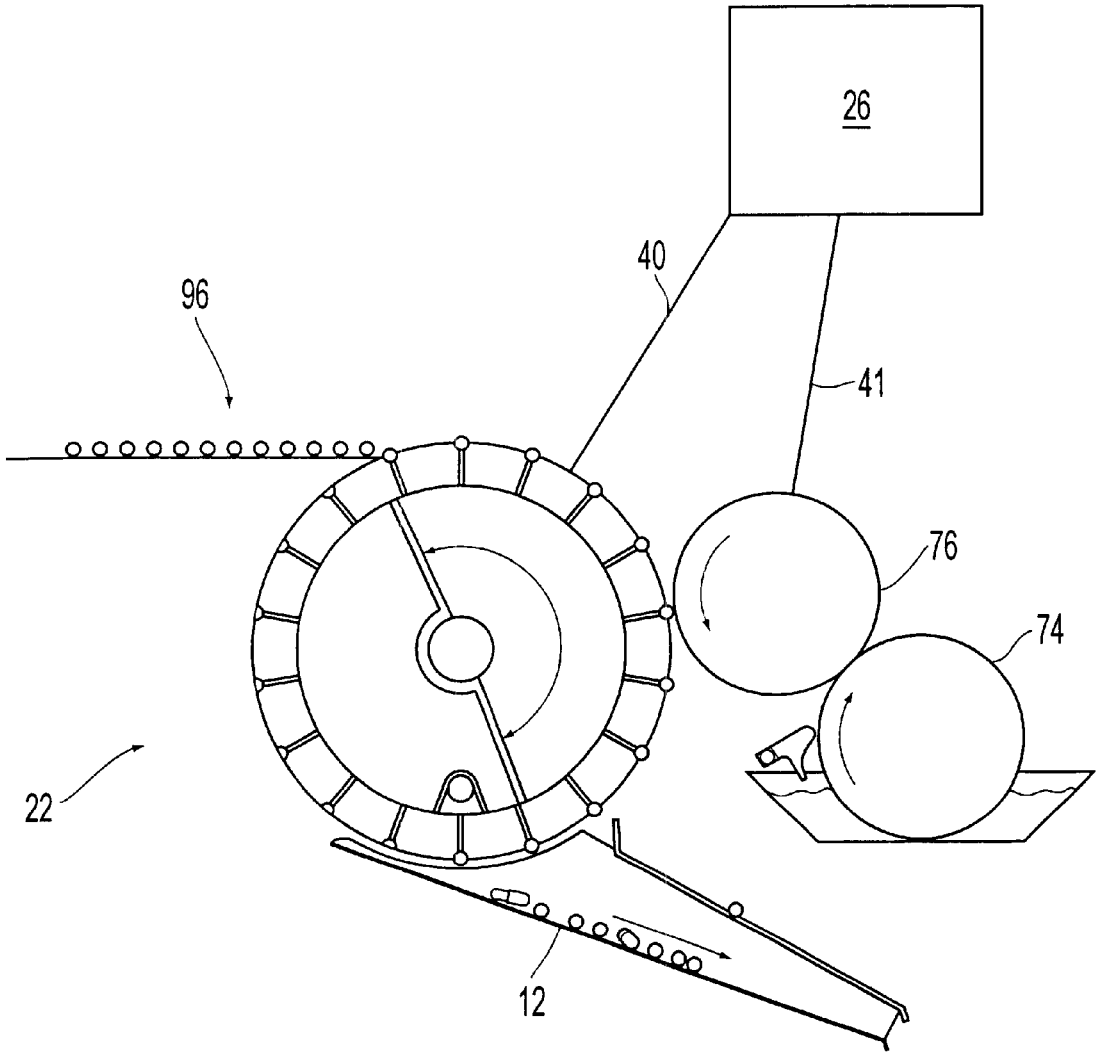
FIG. 8 is a cross-section view of the spin printing apparatus in a second embodiment according to the invention.

In other aspects of the invention, the articles 12 may be arranged in a predetermined order 96 prior to being fed to the printing drum 22. Looking at FIG. 8, it can be understood that when the articles 12 are in a predetermined order, e.g., longitudinally placed in the pockets 42 of the printing drum 22, the pick-up drum 18 and positioning drum 20 are not needed. This arrangement may be suitable for caplets as well as capsules because no rectifier 50 is necessary. Additionally, the control unit 26 may be connected via connections 40 and 41 to the printing drum 22 and the printing roller 76 using lines 40 arid 41 mutually exclusive of each other. Alternatively, the control unit 26 may be connected to both via the same connection.

Also, the articles 12 may first pass through a drilling station 90 where a mechanical time-release mechanism is created. See FIG. 9. The time-release mechanism is formed by creating a depression or hole in the coating of the article 12 with a laser or other drilling device so saliva and assorted body acids interact with the chemical composition within the article 12. This allows certain portions of the interior of the articles 12 to be immediately exposed to the stomach and absorbed into the bloodstream when ingested. This feature is more fully described in U.S. Pat. No. 5,367,771 to Roy, the subject matter of which is incorporated herein by reference. From the drilling station 90, the articles 12 are transported to the feeding station 14 as indicated by the arrow.

Figure 10:
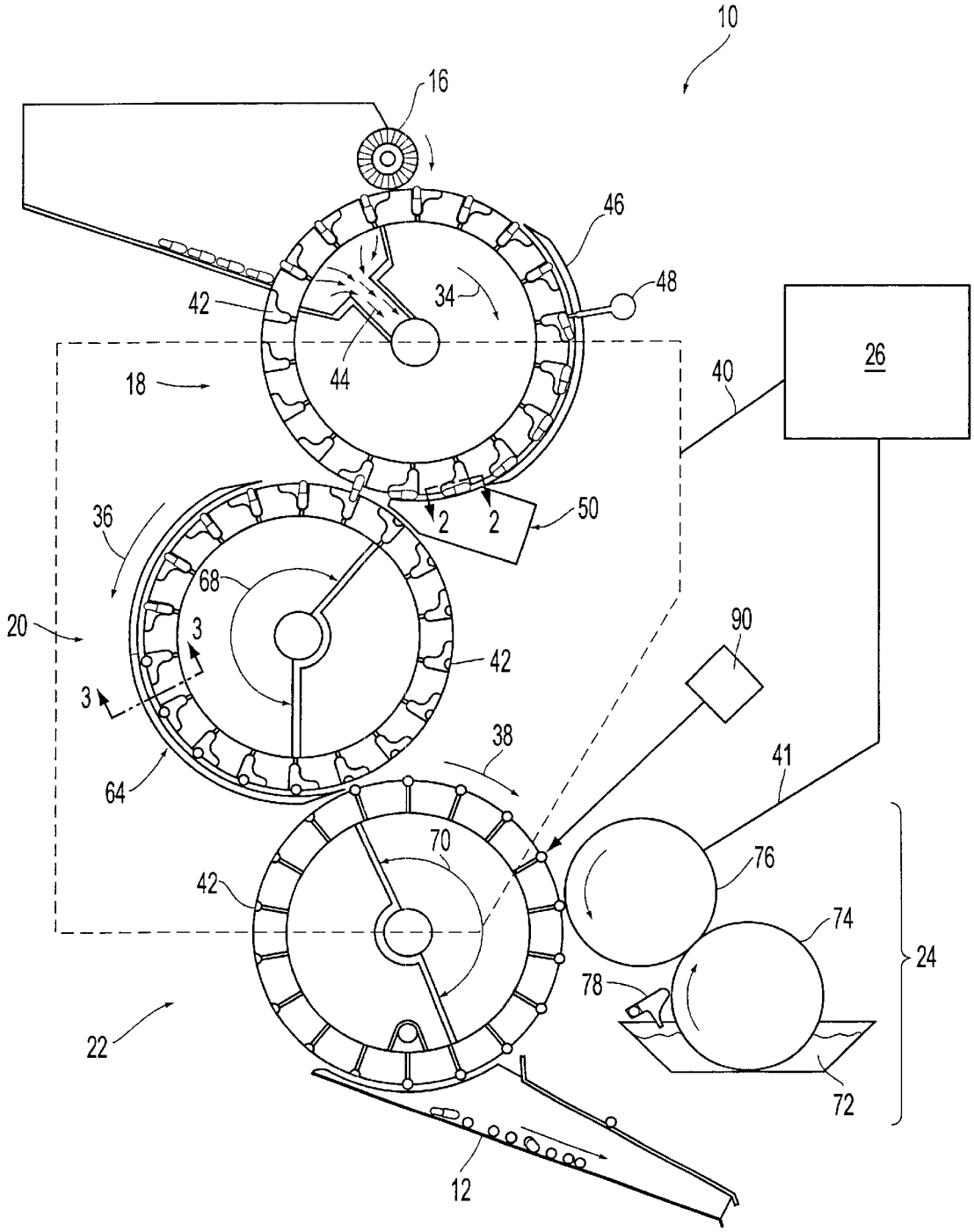
FIG. 10 is a cross-section view of the spin printing apparatus in a fourth embodiment according to the invention.

Optionally, it may be desirable to conceal the depression or hole using the printing station 24. Therefore, the drilling station 90 may be located between the feeding station 14 and the printing station 24 with the control unit 26 positioning the printing roller 76 so that the band of indicia spin printed onto the article 12 conceals the hole or depression. See FIG. 10. Of course, the drilling station 90 can be located downstream of the printing station 24 depending on the desired appearance of the final product.

Once the desired setting of the printing roller 76 is obtained for a given article 12, the setting information may be stored in a memory or otherwise recorded for subsequent use. This may be accomplished by, for example, the user pushing a "save" button on the control unit 26 and associating the saved information with another button (or the same button) such that when the other button is pressed (or the same button is pressed again), the same settings are automatically set in the apparatus 10. Thus, for example, the appropriate settings could be determined and pre-set for a plurality of different products. When a user desires to print indicia on a first of these products, the user then simply pushes a button marked "product A", for example; when the user desired to print indicia on a second of these products, the user simply pushes a button marked "product B", for example, and so on.

Alternatively, the parameter setting process may be fully automated or mostly automated, as described below.

Figure 11:
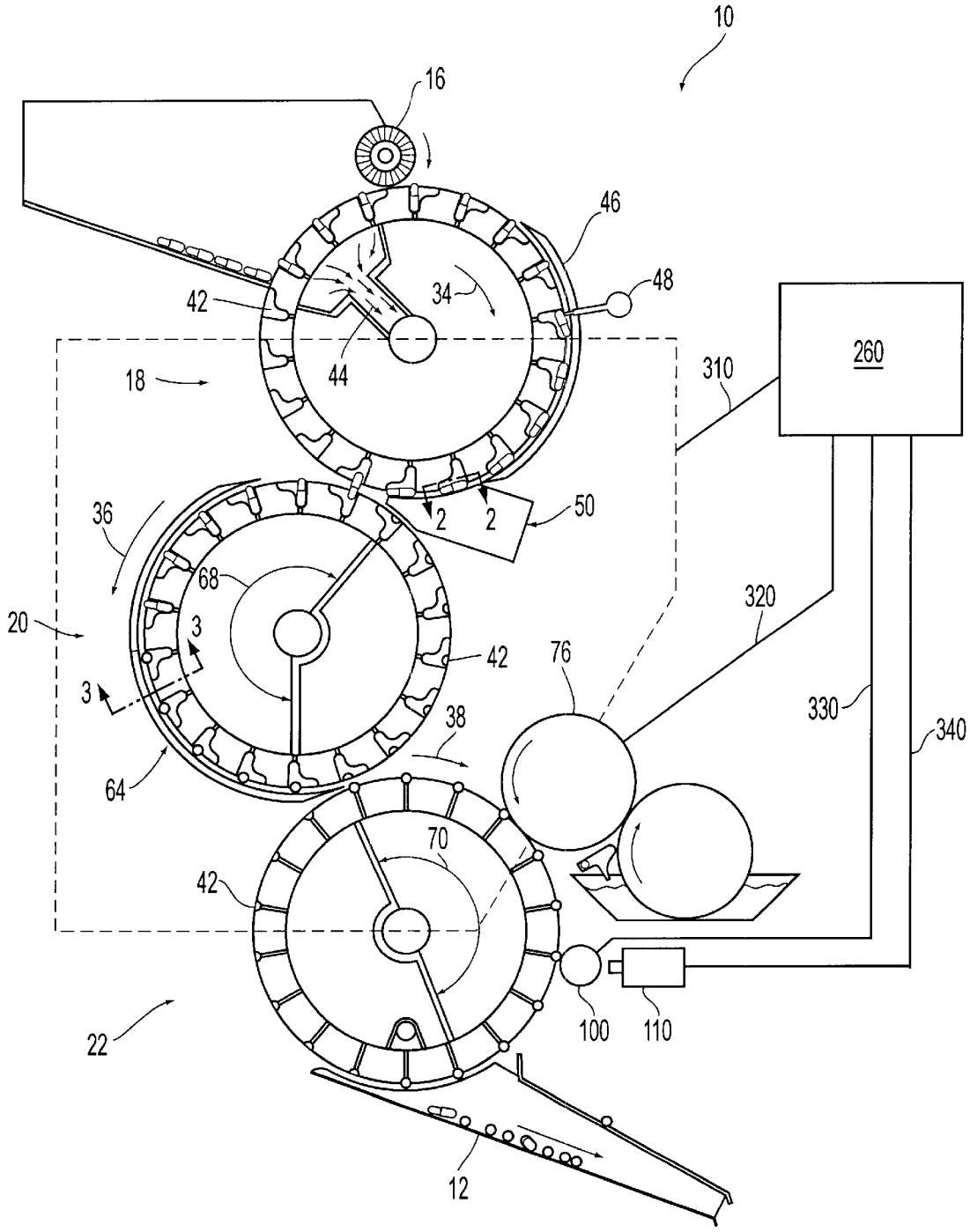
FIG. 11 is a cross-section view of the spin printing apparatus in a fifth embodiment according to the invention.

FIG. 11 is a cross-section view of the spin printing apparatus in a fifth embodiment according to the invention. In this embodiment, a spinner wheel 100 is located adjacent the printing drum 22, downstream of the printing roller 76. As discussed above in connection with the printing operation, the article 12 is maintained in its respective pocket 42 by a constant holding force from the vacuum source 70 within the printing drum 22. The article 12 is consequently rotating very little, if at all, when it reaches the spinner wheel 100. When the spinner wheel 100 makes contact with the article 12, the spinner wheel 100 rotates such that a frictional pressure is applied to the article 12. If necessary, the printing drum 22 may be temporarily stopped while the spinner wheel 100 spins the article 12. The article 12 is thus forced to rotate within its pocket 42 and against the holding force of the vacuum source 70. While the article 12 is being spun in its pocket 42 by the spinner wheel 100, an optical detector 110 performs optical detection of the rotating surface of the article 12, and transmits a detection signal to a control unit 260. The optical detector 110 may be a video camera, a photoelectric cell, or any other device capable of picking up optical information from the article 12 and generating a corresponding signal.

A control unit 260 may be connected to a driving mechanism (not shown) of the pick-up drum 18, positioning drum 20 and/or printing drum 22 by a link 310. Alternatively, the positioning drum 20 and/or printing drum 22 may be under separate control, and thus may not be connected to the control unit 260. The control unit 260 is connected to a driving mechanism(s) (not shown) of the printer roller 76 by a link 320; to a driving mechanism(s) (not shown) of the spinner wheel 100 by a link 330; and to the optical detector 110 by a link 340. The links 310-340 may be any suitable wired, wireless or optical links.

By communicating with the driving mechanism(s), such as one or more motors, one or more hydraulic or pneumatic pistons and/or the like, of the printer roller 76 via the link 320, the control unit 260 may control the same operations of the printer roller 76 as were controlled by the control unit 26 in the previously described embodiments. Likewise, if the control unit 260 is connected to the positioning drum 20 and/or printing drum 22 via the link 310, the control unit 260 may control the same operations of the positioning drum 20 and/or printing drum 22 as were controlled by the control unit 26 in the previously described embodiments.

Control of the spinner wheel 100 by the control unit 260 via the link 330 is much the same as control of the printer roller 76. That is, the spinner wheel 100 is rotated by a motor or the like (not shown) and may also be driven toward and away from the printing drum 20 by another motor, a hydraulic or pneumatic piston or the like (not shown), and the control unit 260 may control these drive mechanisms as appropriate.

Figure 12:
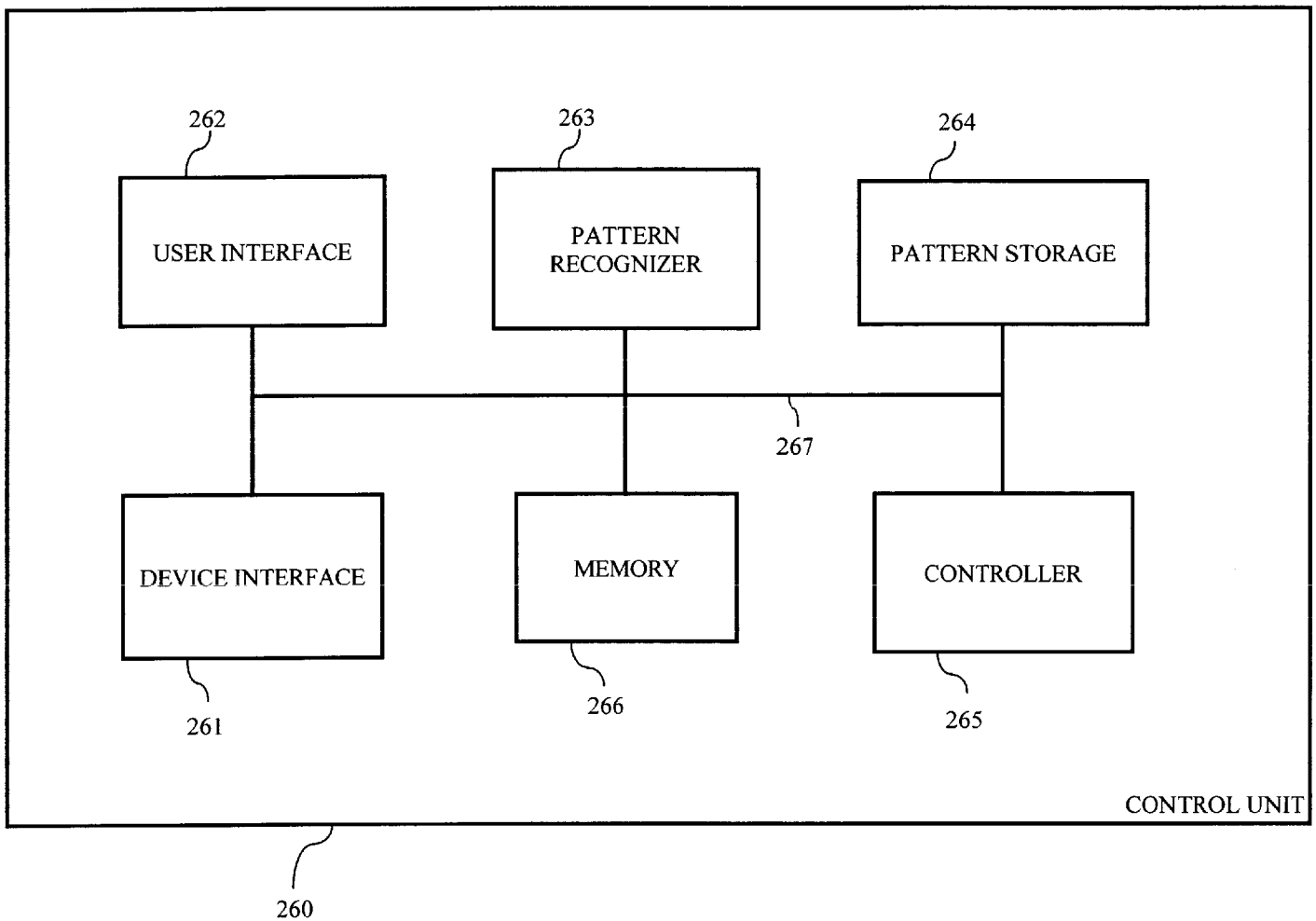
FIG. 12 is a functional block diagram of one exemplary embodiment of a control unit.

FIG. 12 is a functional block diagram of one exemplary embodiment of the control unit 260. The control unit 260 includes a device interface 261, a user interface 262, a pattern recognizer 263, a pattern storage 264, a controller 265, and a memory 266, all of which are interconnected by a data/control bus 267. It will be appreciated from the following discussion that the control unit 260 shown in FIG. 12 is especially adapted for the situation in which the optical detector 110 of FIG. 11 is a video camera. The control unit 260 may have a different structure when the optical detector 110 is a photo sensor such as a photoelectric cell or the like. For example, when the optical detector 110 is a photoelectric cell or the like, the pattern recognizer 263 and/or the pattern storage 264 may not be necessary.

The control unit 260 is connected to various parts of the apparatus 10 via the links 310–340 as described above via the device interface 261. Through the user interface 262, the user may input instructions and/or other information for operation of the apparatus 10. The control unit 260 may also output current settings, operating status, arid/or the like to a display device (not shown) via the user interface 262 for view by the user. The user interface 262 may be a part of or connected to the control unit 26 shown in FIG. 4. However, it will appreciated from the following discussion that many or all of the user input described above in connection with the other embodiments is not necessary in this embodiment; thus, many of the switches, buttons etc. described above may not be necessary in this embodiment.

The pattern recognizer 263 may be any known or later-developed device that compares a detected pattern with a known pattern. For example, the pattern recognition may use well-known Optical Character Recognition (OCR) technology or the like.

The pattern storage 264 stores known or target patterns that may be used for comparison with patterns picked up by the optical detector 110. For example, the pattern storage 264 may store a pattern of each character of each indicia that is to be printed, such as each letter of "Acme Pharmaceuticals" when the words "Acme Pharmaceuticals" are to be printed as the indicia. As another example, the pattern storage 264 may store patterns of the entire indicia.

The controller 265 controls the flow of data within the control unit 260, receives information from various parts of the apparatus 10 via the device interface 261, and generates and transmits operating instructions to various parts of the apparatus via the device interface 261.

The memory 266 may store programs necessary for the operation of the control unit 260, may serve as a buffer for data coming into or going out of the control unit 260, and may temporarily store data in one or more interim stages during processing of the data within the control unit 260.

The memory 266 and the pattern storage 264 shown in FIG. 12 can be implemented using any appropriate combination of alterable, volatile or non-volatile memory or non-alterable, or fixed, memory. The alterable memory, whether volatile or non-volatile, can be implemented using any one or more of static or dynamic RAM, a floppy disk and disk drive, a writable or re-writeable optical disk and disk drive, a hard drive, flash memory or the like. Similarly, the non-alterable or fixed memory can be implemented using any one or more of ROM, PROM, EPROM, EEPROM, an optical ROM disk, such as a CD-ROM or DVD-ROM disk, and disk drive or the like. Furthermore, it should be appreciated that the memory 266 and the pattern storage 264 may be different locations of the same memory.

Figure 13:
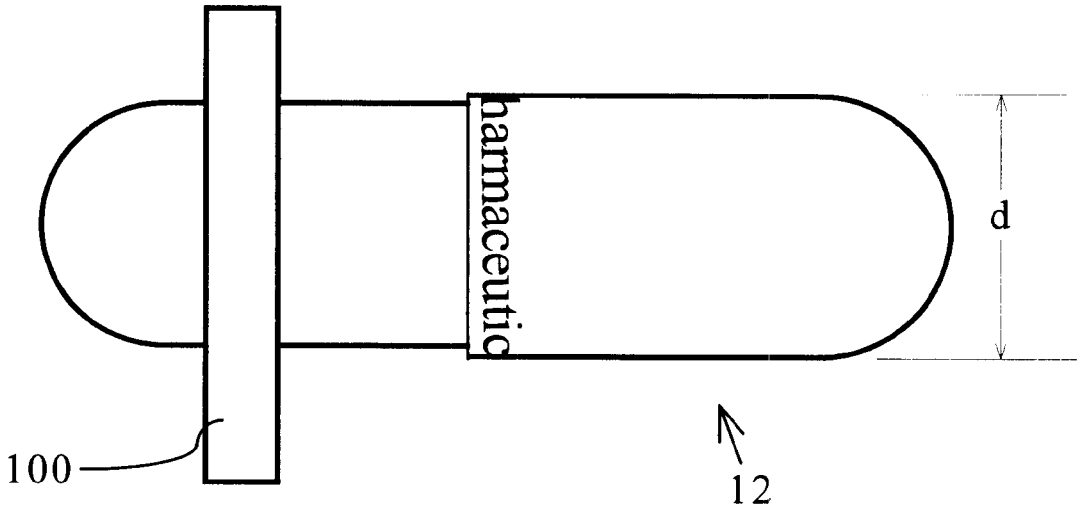
FIG. 13, is a side view of a spinner wheel and an article 12 having a band of indicia printed around the circumference thereof.
Figure 14A:
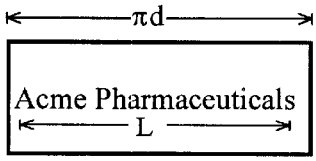
FIGS. 14(*a*)-14(*e*) show examples of images picked up by an optical detector.
Figure 14B:
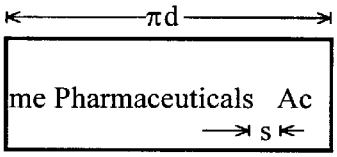
Figure 14C:
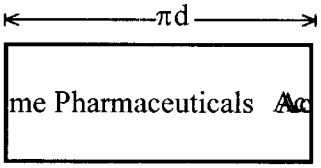
Figure 14D:
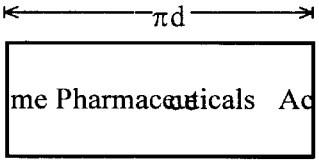
Figure 14E:
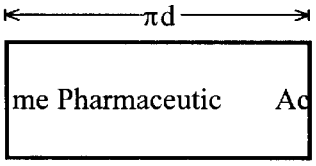

The optical detector 110 is focused on a plane tangent to the article 12. As shown in FIG. 13, the article 12 has a band of indicia printed around the circumference of the cap portion of the article 12, which has a diameter d. It should be appreciated that the indicia may be printed around the body of the article 12, instead of or in addition to the cap portion. It should also be appreciated that the article 12 may be a one-piece caplet or the like with a constant diameter, having no cap portion.

The diameter d may be input to the control unit 260 by a user via the user interface 262. Alternatively, the diameter d may be automatically detected using the optical detector 110. For example, if the peripheral speed of the printing drum 20 is known, the printing drum 20 may initially move the article 12 completely past the optical detector 110, the optical detector 110 may detect the leading and trailing sides of the article as it passes, and the controller 265 may calculate the distance d based on the time it took for the article 12 to pass the optical detector 110. As another example, when the optical detector 110 is a video camera, a plan-view image of the entire article 12 may be picked up and the distance d may be calculated based on the number of pixels wide the plan-view image is. (In this case, the optical detector does not need to focused on the tangent plane--rather, a "best overall focus" of the article 12 may be used during determination of the diameter d.)

The spinner wheel 100 is preferably offset from the band of indicia, as shown in FIG. 13, so that it contacts the article somewhat close to one end of the article. With this construction, the optical detector 110 has a clear view of the indicia, and the spinner wheel 100 does not smear or rub off the indicia by contacting the indicia. However, it should be appreciated that, as long as the optical detector 110 can be arranged at a position that allows it a clear view of the indicia, either directly or via one or more optical guide elements such as mirrors, for example, the spinner wheel 100 may be positioned anywhere along the article 12. Furthermore, rather than a single spinner wheel 100, a plurality of spinner wheels 100 may be provided. For example, two spinner wheels may be provided, located respectively near opposite ends of the article 12.

As the article 12 is rotated by the spinner wheel 100, the optical detector 110 picks up an image of the indicia, when the optical detector 110 is a video camera or the like, or detects one or more points that are part of or are associated with the indicia, when the optical detector 110 is a photoelectric cell or the like.

FIGS. 14(*a*)-14(*e*) show exemplary images picked up by the optical detector 110 when the optical detector 110 is a video camera. In these examples, indicia forming the words "Acme Pharmaceuticals" are printed around the circumference of the article 12. If necessary, a mask (not shown) or the like with a slit extending in a direction transverse to the direction of rotation of the article 12 may be used to screen out unfocused parts of the article 12 during image pick-up by the optical detector 110, thus allowing the optical detector 110 to pick up an image from only a narrow band of exposed area of the article 12 at any given instant in time.

FIG. 14(*a*) shows an example of an image when the image pick-up operation of the optical detector 110 begins exactly at the beginning of the word "Acme." In this example, the spinner wheel 100 rotates the article 12 one full turn while the optical detector 110 performs the image pick-up operation. Thus, as shown, the resulting image has a length of $\pi d$.

In actuality, it is unlikely that, when the article 12 is brought into a position facing the optical detector 110 in FIG. 11, the article 12 will be oriented such that the image pick-up operation will begin exactly at the beginning of the word "Acme". If it is desired to perform the image pick-up operation beginning exactly at the beginning of the word "Acme", the article 12 may be rotated by the spinner wheel 100 under control of the control unit 260 until the letter "A" of "Acme" is detected by the optical detector using optical character recognition or the like, or until a separately provided reference mark (not shown) on the article 12 is detected by a photoelectric cell, by optical character recognition, or the like. The image pick-up operation would then commence upon detection of the letter "A" or other reference mark.

Alternatively, the image pick-up operation may begin as soon as the article 12 is brought into a position facing the optical detector 110. For example, as shown in FIG. 14(*b*), the image pick-up operation may begin with the letter "m" of "Acme." As in FIG. 14(*a*), the spinner wheel 100 rotates the article 12 one full turn while the optical detector 110 performs the image pick-up operation, and the resulting image has a length of πd.

If an initial position of the article 12 is such that the image pick-up operation would, if immediately commenced, begin in the middle of a character, e.g., in the middle of the character "m", the article 12 may be rotated by the spinner wheel 100 under control of the control unit 260 until any character is detected by the optical detector using optical character recognition or the like. The image pick-up operation may then commence from the detected character. Alternatively, the image pick-up operation may commence in the middle of the character, e.g., the character "m", and continue for a length of πd. In this case, the image pick-up operation would then end in the middle of the same character. The image could then be electronically processed to combine the first and last parts of the beginning/ending character.

Once an image has been obtained as described above, the control unit 260 may process the image to determine whether the indicia on the article 12 extends the desired length around the circumference. This may be done in various ways. For example, the length L of the indicia, shown in FIG. 14(*a*), could be detected using any known or later developed method, such as by determining the number of image pixels present along the length L and multiplying by a known length per pixel, and compared with a target value. When the optical detector 110 is a photo sensor such as a photoelectric cell or the like, the length L could be determined by detecting the contrast in reflectance between the indicia and the blank part of the article bearing no indicia, and calculating the length L based on the time between the blank space-to-indicia transition and the indicia-to-blank space transition. If the length L were different from the target value, the control unit 260 could adjust the length L by adjusting the distance from the printing roller 76 to the positioning drum 20, the speed of the printing roller 76 with respect to the positioning drum 20, and/or the contact force of the printing roller 76.

As another example, the length S of the space between the end and beginning of the indicia, shown in FIG. 14(*b*), could be detected, e.g., by the same methods described above in connection with the length L, and compared to a target value. If the length S were different from the target value, the control unit 260 could adjust the length S by adjusting the distance from the printing roller 76 to the positioning drum 20, the speed of the printing roller 76 with respect to the positioning drum 20, and/or the contact force of the printing roller 76.

Alternatively, rather than detecting the length L or the length S, a pattern analysis could be performed. For example, the overall pattern of the indicia "Acme Pharmaceuticals" could be detected and compared with a target pattern. In the case of FIGS. 14(*c*) and 14 (*d*), since the images contain unrecognizable characters, the detected patterns do not match "Acme Pharmaceuticals" and thus it can be determined that an adjustment must be made. In FIG. 14(*e*), the last three characters ("als") are missing from the "Acme Pharmaceuticals" indicia. Therefore, the detected pattern does not match "Acme Pharmaceuticals" and thus it can be determined that an adjustment must be made.

When the overall pattern is to be detected and compared, it may be necessary to store all possible variations of the correct pattern in the pattern storage 264. For example, the patterns "Acme Pharmaceuticals", "cme Pharmaceuticals A", "me Pharmaceuticals Ac", "e Pharmaceuticals Acm", "Pharmaceuticals Acme", etc. may need to be stored.

With a simple "matches/doesn't match" analysis, the control unit 260 does not know which way to adjust the length, i.e., the system does not know whether to make the length longer or shorter. The system could "guess" by adjusting by one increment in one direction, performing a second pattern match analysis, adjusting by one increment in the other direction if the second pattern match analysis failed, performing a third pattern match analysis, adjusting by another increment in the first direction if the third pattern match analysis failed, etc.

As an option to the simple "matches/doesn't match" analysis of the whole indicia pattern, optical character recognition may be performed on each character, as described below with reference to FIGS. 14(*c*) to 14(*e*).

The "Acme Pharmaceuticals" contains one occurrence of "A" , three occurrences of "c", three occurrences of "a", two occurrences of "m", two occurrences of "e", and one occurrence each of "P", "h", "r", "u", "t", "i", "l" and "s". After optical character recognition is performed on each character occurring over the length πd, the control unit 260 may determine how many times each character occurs, and/or whether there are any unrecognizable characters. Using this information, the control unit 260 can determine whether the current settings are suitable, i.e., whether the band of indicia is being printed over the correct length of the circumference of the articles 12.

In FIG. 14(*c*), it can be seen that there is at least one unrecognizable character in the indicia. This situation has occurred because the length of the indicia is too long, and one part of the indicia, the characters "Ac", has been printed twice such that the second occurrence of "Ac" overlaps the first occurrence of "Ac" in an offset manner that renders the characters unrecognizable. When the control unit 260 detects that there is an unrecognizable character present, the control unit 260 makes necessary adjustments to the position, speed and/or contact force of the printing wheel 76 to decrease the length of the indicia. The length of the indicia may be decreased incrementally and the indicia length re-checked after each increment, or the controller 265 may calculate an appropriate decrease amount based on how many recognizable or unrecognizable characters are present. For example, if seventeen characters out of the total of nineteen characters of "Acme Pharmaceuticals are recognized, the controller 265 will calculate a smaller adjustment than if only sixteen or fewer characters were recognized.

FIG. 14(*d*) shows an example of another situation in which the indicia contains an unrecognizable character. In this case, the characters "ce" of "Pharmaceuticals" have been printed twice, with the second occurrence overlapping the characters "eu" of "Pharmaceuticals" and rendering them unrecognizable. In this example, it will be appreciated that printing of the article 12 began with the letter "e" of "Pharmaceuticals", rather than with the letter "A" of "Acme" . Thus, it should be appreciated that the printing wheel 76 does not necessarily print the indicia beginning from the beginning of the indicia, but may begin from any point.

FIG. 14(*e*) shows an example in which the indicia length is too short. This is a situation that occurs when, for example, the printing roller 76 is in contact with the article 12 an insufficient length of time, does not have a sufficient contact force with respect to the article 12, and/or is too far away from the positioning drum 20. As a result, part of the indicia is omitted. In FIG. 14(*e*), since there are only two occurrences of "a" and no occurrences of either "l" or "s", the control unit 260 can determine that the indicia has not been properly printed.

Furthermore, the fact that there are no unrecognizable characters in the indicia of FIG. 14(*e*) indicates to the control unit 260 that the indicia is too short. Therefore, the control unit 260 makes necessary adjustments to the position, speed and/or contact force of the printing wheel 76 to increase the length of the indicia. The length of the indicia may be decreased incrementally and the indicia length re-checked after each increment, or the controller 265 may calculate an appropriate decrease amount based on how many recognizable or unrecognizable characters are present. For example, if sixteen characters out of the total of nineteen characters of "Acme Pharmaceuticals" are recognized, the controller 265 will calculate a smaller adjustment than if only fifteen or fewer characters were recognized.

After the appropriate adjustment has been achieved, the spinner wheel 100 may be moved away from the printing drum 22 so that it does not contact articles 12 that are subsequently moved passed the optical detector 110.

Figure 15:
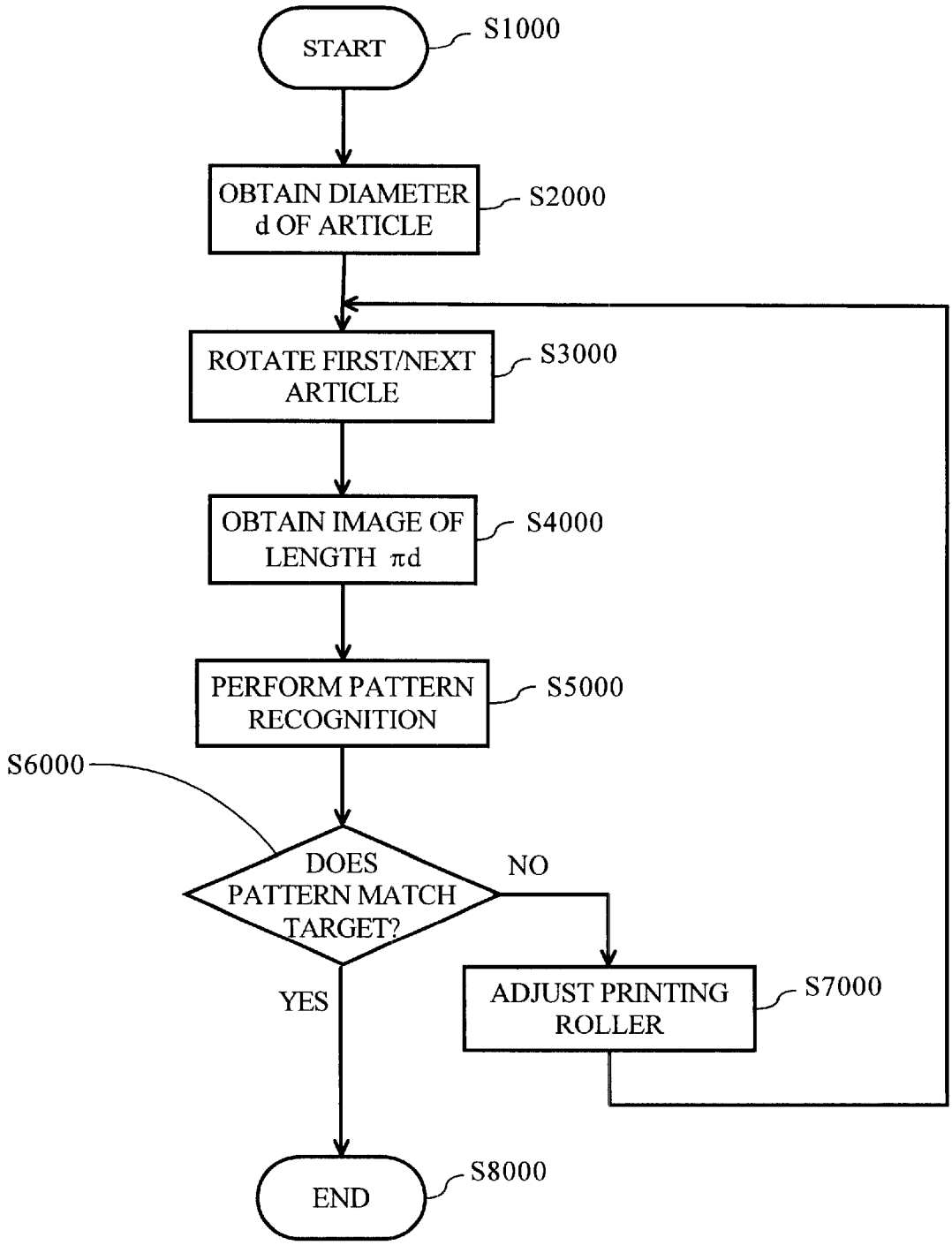
FIG. 15 is a flowchart outlining one exemplary embodiment of a method for adjusting an indicia length according to the invention.

FIG. 15 is a flowchart outlining one exemplary embodiment of a method for adjusting an indicia length according to this invention. Beginning in step S1000, control continues to step S2000, where a diameter d of an article on which indicia has been printed is obtained. Next, in step S3000, the article is rotated. Then, in step S4000, an image of length $\pi d$ of the surface of the article is obtained. It should be appreciated that step S4000 is performed during step S3000; in other words, the image pick-up is performed while the article is being rotated. The method then continues to step S5000.

In step S5000, pattern recognition is performed on the image obtained in step S4000. Next, in step S6000, a determination is made whether a pattern contained in the obtained image matches a target pattern. If the obtained pattern matches the target pattern, the method jumps to step S8000. Otherwise, the method continues to step S7000.

In step S7000, the printing roller or other device that has been used to mark the indicia on the article is adjusted. The method then returns to step S3000, where a next article with indicia printed thereon using the adjusted parameters is rotated. The method then repeats steps S4000–S6000. When the obtained pattern matches the target pattern, the method jumps to step S8000 and ends. In other words, when the obtained pattern matches the target pattern, the desired indicia length has been achieved and printing of the articles continues at that setting.

Figure 16:
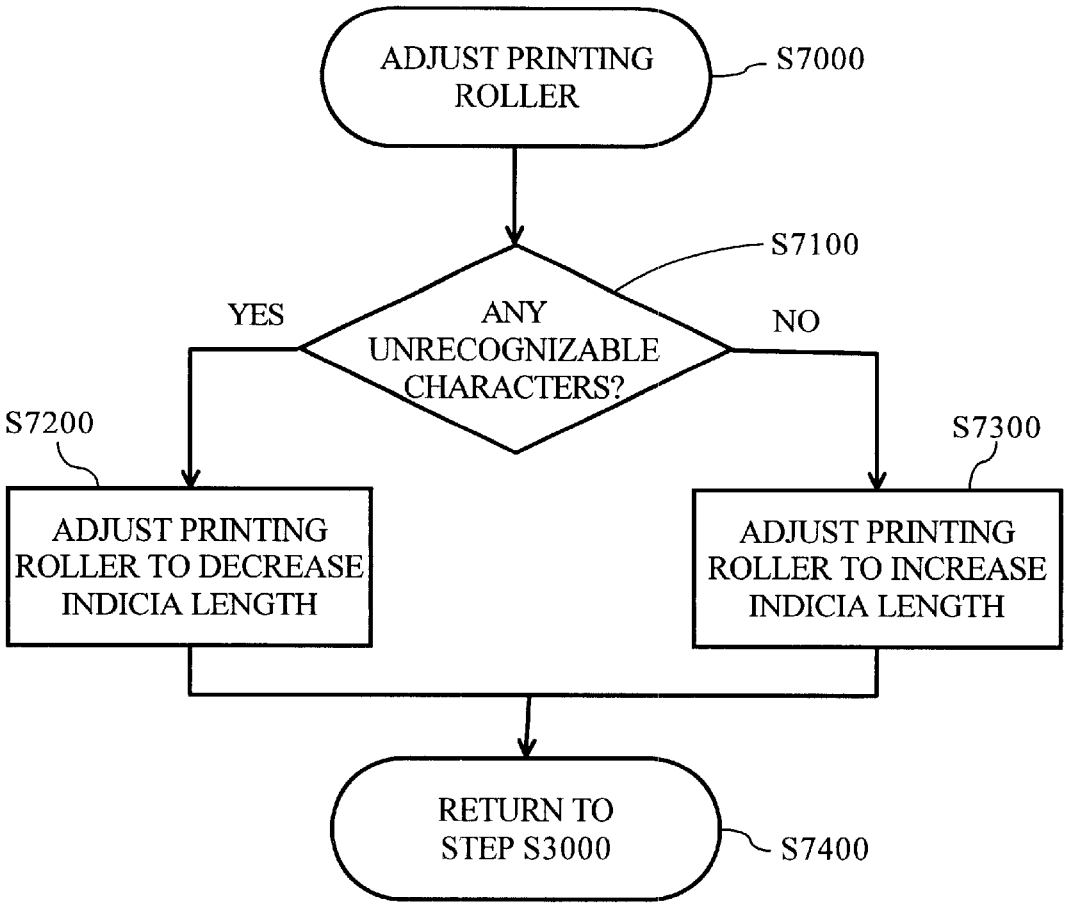
FIG. 16 is a flowchart outlining one exemplary embodiment of a method for adjusting a printing roller according to the invention.

FIG. 16 is a flowchart outlining one exemplary embodiment of a method for adjusting a printing roller according to this invention. Beginning in step S7000, the method continues to step S7100, where a determination is made whether the obtained pattern contains any unrecognizable characters. If the obtained pattern contains any unrecognizable characters, the method continues to step S7200. Otherwise, the method jumps to step S7300.

In step S7200, the printing roller or other device that has been used to mark the indicia on the article is adjusted to decrease the indicia length. The method then jumps to step S7400.

In step S7300, the printing roller or other device that has been used to mark the indicia on the article is adjusted to increase the indicia length. The method then continues to step S7400 and returns to step S3000 of FIG. 15.

Figure 17:
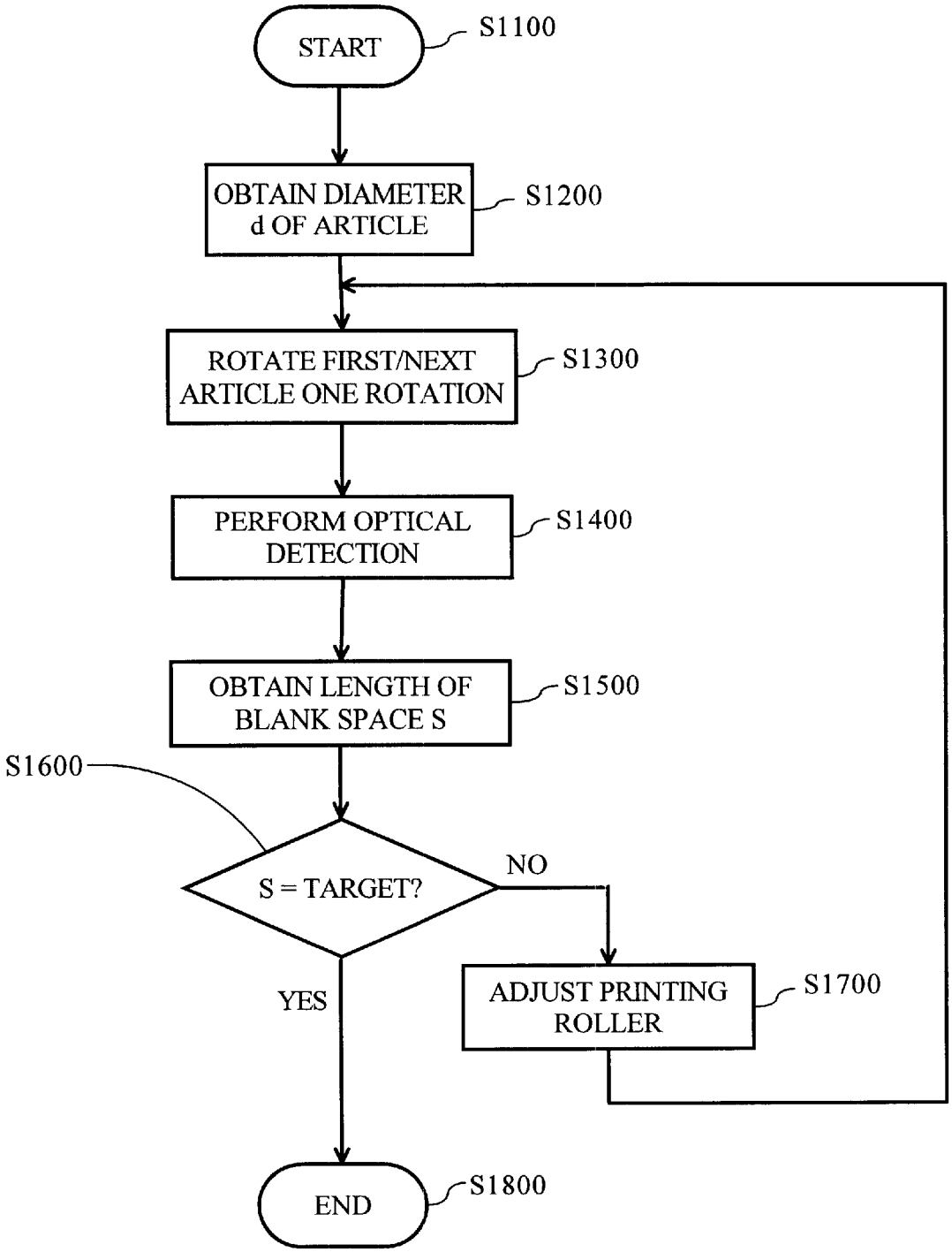
FIG. 17 is a flowchart outlining another exemplary embodiment of a method for adjusting an indicia length according to the invention.

FIG. 17 is a flowchart outlining another exemplary embodiment of a method for adjusting an indicia length according to this invention. It should be appreciated that the method of FIG. 17 may be performed using either an image pick-up device such as a video camera, or a simple photo detector such as a photoelectric cell.

Beginning in step S1100, control continues to step S1200, where a diameter d of an article on which indicia has been printed is obtained. Next, in step S1300, the article is rotated one rotation, or in other words, such that a peripheral length $\pi d$ of the article is rotated past an optical detector. Then, in step S1400, optical detection is performed. It should be appreciated that step S1400 is performed during step S1300; in other words, the optical detection is performed while the article is being rotated. The method then continues to step S1500.

In step S1500, a length S of a blank space, i.e., a space in which no indicia is printed, is obtained. Next, in step S1600, a determination is made whether the obtained length S matches a target length. If the obtained length S matches the target length, the method jumps to step S1800. Otherwise, the method continues to step S1700.

In step S1700, the printing roller or other device that has been used to mark the indicia on the article is adjusted. The method then returns to step S1300, where a next article with indicia printed thereon using the adjusted parameters is rotated. The method then repeats steps S1400–S1600. When the obtained length S matches the target length, the method jumps to step S1800 and ends. In other words, when the obtained length S matches the target length, the desired indicia length has been achieved and printing of the articles continues at that setting.

It should be appreciated that, while the length S of a blank space is obtained and compared with a target value in the method of FIG. 17, it is also possible to obtain a length L of an indicia-printed space and compare the obtained length L with a corresponding target value.

Figure 18:
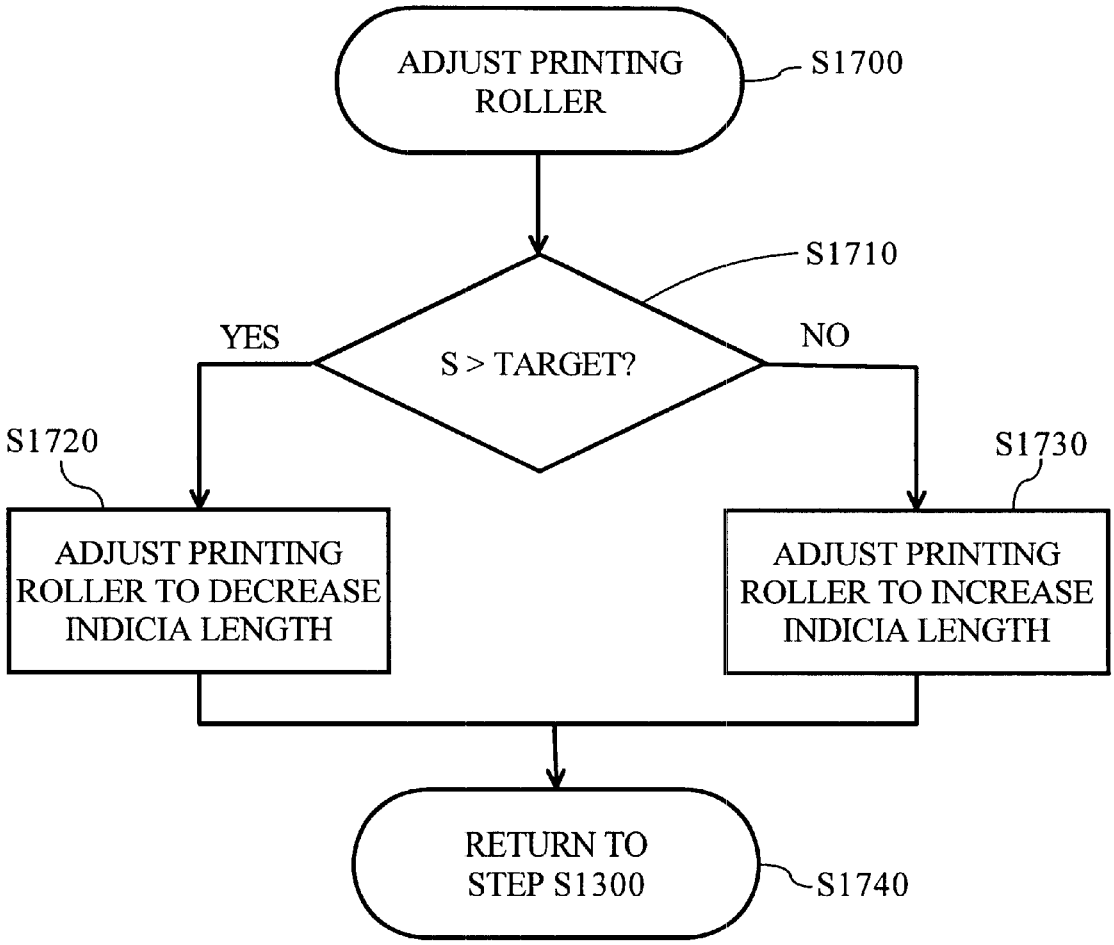
FIG. 18 is a flowchart outlining another exemplary embodiment of a method for adjusting a printing roller according to the invention.

FIG. 18 is a flowchart outlining another exemplary embodiment of a method for adjusting a printing roller according to this invention. Beginning in step S1700, the method continues to step S1710, where a determination is made whether the obtained length S is greater than a target length. If the obtained length S is greater than the target length, the method continues to step S1720. Otherwise, the method jumps to step S1730.

In step S1720, the printing roller or other device that has been used to mark the indicia on the article is adjusted to decrease the indicia length. The method then jumps to step S1740.

In step S1730, the printing roller or other device that has been used to mark the indicia on the article is adjusted to increase the indicia length. The method then continues to step S1740 and returns to step S1300 of FIG. 17.

The control unit 260 shown in FIG. 12 is, in various exemplary embodiments, implemented on a programmed general purpose computer. However, the control unit 260 can also be implemented on a special purpose computer, a programmed microprocessor or microcontroller and peripheral integrated circuit elements, an ASIC or other integrated circuit, a digital signal processor, a hardwired electronic or logic circuit such as a discrete element circuit, a programmable logic device such as a PLD, PLA, FPGA or PAL, or the like. In general, any device, capable of implementing a finite state machine that is in turn capable of implementing the flowcharts shown in FIGS. 15–18 can be used to implement the data processor 200. Moreover, the control unit 260 can be implemented as software executing on a programmed general purpose computer, a special purpose computer, a microprocessor or the like.

While the invention has been described in conjunction with the specific embodiments thereof, it is evident that many alternatives, modifications, and variations may be apparent to those skilled in the art. Also, while many components and/or method aspects are described above in cooperative association, each component and/or method aspect may form an independent aspect of the invention separately useable from the other aspects of the invention. Accordingly, the preferred embodiment of the invention as set forth herein is intended to be illustrative, not limiting. Various changes may be made without departing from the spirit and scope of the present discussion.

For example, while the spinner wheel 100 and the optical detector 110 shown in FIG. 11 are incorporated as part of the apparatus 10, they may instead be part of a separate apparatus. Furthermore, while the spinner wheel 100 is provided in the above-described embodiment of FIG. 11 as a mechanism that rotates the articles 12, any other suitable mechanism may be substituted to rotate the articles. For example, the articles may simply be rolled down a ramp. In this case, the optical detector 110 would include a tracking mechanism and be able to track the articles 12 while they rolled in order to obtain the desired image.

What is claimed is:

1. A spin printing apparatus, comprising:

a conveyor including a plurality of pockets that receive a plurality of pellet shaped articles;

a printing roller spaced from the conveyor at a predetermined distance, the printing roller contact-printing a band of indicia on each of the pellet shaped articles;

a detection unit that automatically detects information associated with a length of the band of indicia of one of the pellet shaped articles; and a device that adjusts the predetermined distance based on the detected information to change the length of the band of the indicia.

2. The apparatus of claim 1, wherein the detection unit comprises:

a rotation mechanism that rotates the one of the pellet shaped articles about a longitudinal axis of the one of the pellet shaped articles; and one of a video camera and a photo sensor;

wherein the information associated with the length of the band of indicia is optical information obtained from a peripheral surface of the one of the pellet shaped articles by the one of the video camera and the photo sensor while the one of the pellet shaped articles is rotating.

3. The apparatus of claim 2, wherein the detection unit comprises a photo detector and wherein the optical information comprises one of:

(a) an actual length of the band of indicia; and (b) a length of a blank space between an ending point of the band of indicia and a beginning point of the band of indicia.

4. The apparatus of claim 2, wherein the detection unit comprises a video camera and further comprises a pattern recognition unit, and wherein the optical information comprises one of:

(a) an actual length of the band of indicia;

(b) a length of a blank space between an ending point of the band of indicia and a beginning point of the band of indicia;

(c) whether any unrecognizable characters are present in the band of indicia; and (d) whether a pattern of the indicia matches a stored target pattern.

5. A method for spin printing pellet shaped articles, comprising:

distributing the pellet shaped articles on a moving conveyor;

transporting the pellet shaped articles to a printing roller positioned a predetermined distance from the conveyor;

printing a band of indicia onto the pellet shaped articles;

detecting information associated with a length of the band of indicia of one of the pellet shaped articles; and adjusting the predetermined distance of the printing roller to the conveyor based on the detected information, thereby changing the length of the band of indicia printed onto the pellet shaped articles.

6. The method of claim 5, wherein the detecting comprises:

rotating the one of the pellet shaped articles about a longitudinal axis of the one of the pellet shaped articles; and obtaining optical information from a peripheral surface of the one of the pellet shaped articles as the information associated with a length of the band of indicia while the one of the pellet shaped articles is rotating, using one of a video camera and a photo sensor.

7. The method of claim 6, wherein the obtaining the optical information comprises using a photo sensor, and further comprises one of:

(a) obtaining an actual length of the band of indicia; and (b) obtaining a length of a blank space between an ending point of the band of indicia and a beginning point of the band of indicia.

8. The method of claim 6, wherein the obtaining the optical information comprises using a video camera and performing pattern recognition, and further comprises one of:

(a) obtaining an actual length of the band of indicia;

(b) obtaining a length of a blank space between an ending point of the band of indicia and a beginning point of the band of indicia;

(c) determining whether any unrecognizable characters are present in the band of indicia; and (d) determining whether a pattern of the indicia matches a stored target pattern

9. A spin printing apparatus, comprising:

a conveyor including at least one pocket for receiving a pellet shaped article;

a printing roller adjacent the conveyor, the printing roller providing a predetermined amount of indicia to the pellet shaped article under a selected contact force to form a band of indicia;

a detection unit that automatically detects information associated with a length of the band of indicia; and a device that adjusts the selected contact force based on the detected information to change a length of a band of the predetermined amount of indicia.

10. The apparatus of claim 9, wherein the detection unit comprises:

a rotation mechanism that rotates the pellet shaped article about a longitudinal axis of the pellet shaped article; and one of a video camera and a photo sensor;

wherein the information associated with the length of the band of indicia is optical information obtained from a peripheral surface of the pellet shaped articles by the one of the video camera and the photo sensor while the pellet shaped article is rotating.

11. The apparatus of claim 10, wherein the detection unit comprises a photo sensor and wherein the optical information comprises one of:

(a) an actual length of the band of indicia; and (b) a length of a blank space between an ending point of the band of indicia and a beginning point of the band of indicia.

12. The apparatus of claim 10, wherein the detection unit comprises a video camera and further comprises a pattern recognition unit, and wherein the optical information comprises one of:

(a) an actual length of the band of indicia;

(b) a length of a blank space between an ending point of the band of indicia and a beginning point of the band of indicia;

(c) whether any unrecognizable characters are present in the band of indicia; and (d) whether a pattern of the indicia matches a stored target pattern.

13. A method for spin printing pellet shaped articles, comprising:

transporting the pellet shaped articles to a printing roller that transfers indicia to the pellet shaped articles under a contact force to form a band of indicia on the pellet shaped articles;

detecting information associated with a length of the band of indicia of one of the pellet shaped articles; and adjusting the contact force based on the detected information to change the length of the band of indicia transferred to a circumference of the pellet shaped articles.

14. The method of claim 13, wherein the detecting comprises:

rotating the one of the pellet shaped articles about a longitudinal axis of the one of the pellet shaped articles; and obtaining optical information from a peripheral surface of the one of the pellet shaped articles as the information associated with the length of the band of indicia while the one of the pellet shaped articles is rotating, using one of a video camera and a photo sensor.

15. The method of claim 14, wherein the obtaining the optical information comprises using a photo sensor, and further comprises one of:

(a) obtaining an actual length of the band of indicia; and (b) obtaining a length of a blank space between an ending point of the band of indicia and a beginning point of the band of indicia.

16. The method of claim 14, wherein the obtaining the optical information comprises using a video camera and performing pattern recognition, and further comprises one of:

(a) obtaining an actual length of the band of indicia;

(b) obtaining a length of a blank space between an ending point of the band of indicia and a beginning point of the band of indicia;

(c) determining whether any unrecognizable characters are present in the band of indicia; and (d) determining whether a pattern of the indicia matches a stored target pattern.

17. A spin printing apparatus, comprising:

a conveyor including at least one pocket for receiving at least one of a caplet and a capsule having a circumference;

a printing roller frictionally engaging the caplet or capsule a predetermined amount to selectively print a band of indicia along an entire circumference of the caplet or capsule;

a detection unit that automatically detects information associated with a length of the band of indicia; and a device that adjusts the predetermined amount the printing roller frictionally engages the caplet or capsule based on the detected information to change the length of the band of the indicia.

18. The apparatus of claim 17, wherein the detection unit comprises:

a rotation mechanism that rotates the caplet or capsule about a longitudinal axis of the caplet or capsule; and one of a video camera and a photo sensor;

wherein the information associated with the length of the band of indicia is optical information obtained from a peripheral surface of caplet or capsule by the one of the video camera and the photo sensor while the caplet or capsule is rotating.

19. The apparatus of claim 18, wherein the detection unit comprises a photo sensor and wherein the optical information comprises one of:

(a) an actual length of the band of indicia; and (b) a length of a blank space between an ending point of the band of indicia and a beginning point of the band of indicia.

20. The apparatus of claim 18, wherein the detection unit comprises a video camera and further comprises a pattern recognition unit, and wherein the optical information comprises one of:

(a) an actual length of the band of indicia;

(b) a length of a blank space between an ending point of the band of indicia and a beginning point of the band of indicia;

(c) whether any unrecognizable characters are present in the band of indicia; and (d) whether a pattern of the indicia matches a stored target pattern.

21. A method for spin printing indicia onto pellet shaped articles, comprising:

transporting the pellet shaped articles to a printing roller that transfers a band of indicia onto an entire circumference of the pellet shaped articles by frictionally engaging the pellet shaped articles;

detecting information associated with a length of the band of indicia of one of the pellet shaped articles; and adjusting an amount the printing roller frictionally engages the pellet shaped articles based on the detected information to change a length of a band of indicia transferred to the pellet shaped articles.

22. The method of claim 21, wherein the detecting comprises:

rotating the one of the pellet shaped articles about a longitudinal axis of the one of the pellet shaped articles; and obtaining optical information from a peripheral surface of the one of the pellet shaped articles as the information associated with the length of the band of inclicia of one of the pellet shaped articles while the one of the pellet shaped articles is rotating, using one of a video camera and a photo sensor.

23. The method of claim 22, wherein the obtaining the optical information comprises using a photo sensor, and further comprises one of:

(a) obtaining an actual length of the band of indicia; and (b) obtaining a length of a blank space between an ending point of the band of indicia and a beginning point of the band of indicia.

24. The method of claim 22, wherein the obtaining the optical information comprises using a video camera and performing pattern recognition, and further comprises one of:

(a) obtaining an actual length of the band of indicia;

(b) obtaining a length of a blank space between an ending point of the band of indicia and a beginning point of the band of indicia;

(c) determining whether any unrecognizable characters are present in the band of indicia; and (d) determining whether a pattern of the indicia matches a stored target pattern.

* * * * *